US010195733B2

(12) United States Patent
Jannitto, Jr. et al.

(10) Patent No.: US 10,195,733 B2
(45) Date of Patent: Feb. 5, 2019

(54) TOOL HANDLE

(71) Applicant: Mayhew Steel Products, Inc., Turner Falls, MA (US)

(72) Inventors: John Jannitto, Jr., Naugatuck, CT (US); John C. Lawless, Conway, MA (US)

(73) Assignee: MAYHEW STEEL PRODUCTS, INC., Turner Falls, MA (US)

( * ) Notice: Subject to any disclaimer, the term of this patent is extended or adjusted under 35 U.S.C. 154(b) by 63 days.

(21) Appl. No.: 15/276,914

(22) Filed: Sep. 27, 2016

(65) Prior Publication Data

US 2017/0050307 A1 Feb. 23, 2017

Related U.S. Application Data

(63) Continuation-in-part of application No. 14/827,729, filed on Aug. 17, 2015, now Pat. No. 10,071,471.

(60) Provisional application No. 62/297,197, filed on Feb. 19, 2016.

(51) Int. Cl.
*B25G 1/00* (2006.01)
*B25G 1/10* (2006.01)

(52) U.S. Cl.
CPC ..... *B25G 1/102* (2013.01); *B25G 1/005* (2013.01); *Y10T 16/476* (2015.01)

(58) Field of Classification Search
CPC . B25G 1/00; B25G 1/10; B25G 1/102; B25G 1/005; Y10T 16/44; Y10T 16/476
See application file for complete search history.

(56) References Cited

U.S. PATENT DOCUMENTS 1,903,548 A * 4/1933 Kreis ..... B21K 25/00 29/254
1,930,238 A * 10/1933 Heller ..... B25B 13/06 411/403
2,123,393 A * 7/1938 Windsor ..... B25G 1/00 279/95
3,173,462 A * 3/1965 Koeppel ..... B25B 23/16 403/361
3,242,526 A * 3/1966 Wilton ..... F21V 35/00 30/451
3,877,327 A * 4/1975 Erm ..... B25B 13/06 81/124.4
4,768,406 A * 9/1988 Fitzwater ..... B25B 23/16 74/551.9
4,969,231 A * 11/1990 Mader ..... B25G 1/00 16/421
5,390,572 A * 2/1995 Gakhar ..... B25B 15/02 16/430

(Continued)

FOREIGN PATENT DOCUMENTS

DE 8907900 U1 * 8/1989 ..... B25B 15/02

*Primary Examiner* — Tyrone V Hall, Jr.
(74) *Attorney, Agent, or Firm* — Lackenbach Siegel, LLP

(57) ABSTRACT

A tool handle has a trilobular configured grip portion, with three outwardly extending generally arcuate lobes. Each lobe has an arcuate surface that subtends an arc of about 45° to 90°, and preferably about 60°. The grip portion has two upper surface lobes and one bottom surface lobe. The bottom surface lobe has spaced oval configured finger engaging recesses. A fixedly disposed metal end cap has a rotatably disposed tang for receiving a lanyard for free movement of the tang and lanyard with operation of the tool.

24 Claims, 34 Drawing Sheets

(56) References Cited

U.S. PATENT DOCUMENTS 5,722,116 A * 3/1998 Lin ..... B25G 1/105 16/436
5,964,009 A * 10/1999 Hoepfl ..... B25G 1/105 16/430
6,029,549 A * 2/2000 Baker ..... B25B 15/02 81/177.4
6,368,536 B1 * 4/2002 Hoepfl ..... B25G 1/105 264/250
6,390,704 B1 * 5/2002 Baudino ..... B43K 23/008 16/430
6,471,186 B1 * 10/2002 Lawless ..... B25C 11/00 254/25
6,772,994 B1 * 8/2004 Lawless ..... B25B 33/00 254/25
6,889,405 B2 * 5/2005 Ritrovato ..... B25G 1/10 15/143.1
7,152,511 B2 * 12/2006 Fen ..... B25G 1/00 81/177.1
D542,620 S * 5/2007 Thompson ..... D8/107
7,523,525 B2 * 4/2009 Lawless ..... B25B 33/00 16/430
8,182,361 B2 * 5/2012 Gill ..... A63B 53/14 473/299
2003/0151269 A1 * 8/2003 Korellis ..... B25G 1/01 294/171
2004/0099102 A1 * 5/2004 Vaughan ..... B25B 13/06 81/124.4
2006/0026800 A1 * 2/2006 Lawless ..... B25G 1/105 16/430
2008/0092337 A1 * 4/2008 Gross ..... B25G 1/102 16/430
2008/0098858 A1 * 5/2008 Thomas ..... B25B 13/02 81/124.2
2008/0276770 A1 * 11/2008 Blum ..... B25B 15/02 81/489
2010/0192733 A1 * 8/2010 Hsieh ..... B25G 1/102 81/177.1
2012/0174342 A1 * 7/2012 Moreau ..... B25B 7/00 24/3.1
2012/0228568 A1 * 9/2012 Leon ..... B25F 1/006 254/21
2012/0246946 A1 * 10/2012 Kreitz ..... B26B 3/00 30/342
2012/0255180 A1 * 10/2012 Powers ..... B25D 3/00 30/167.1
2013/0061724 A1 * 3/2013 Lin ..... B25G 1/102 81/489

* cited by examiner

TOOL HANDLE

PRIOR RELATED APPLICATIONS

This application is a non-provisional application of provisional application U.S. 62/297,197, filed Feb. 19, 2016, and is also a continuation-in-part application of U.S. application Ser. No. 14/827,729, filed Aug. 17, 2015, and claims priorities to the afore-mentioned applications which applications are incorporated herein in their entireties, by reference thereto.

BACKGROUND OF THE INVENTION

Field of the Invention

This invention relates to hand tools and hand tool handles.

Background and Discussion of the Prior Art

It is generally known to provide a soft elastomeric molded over cover on a molded hard thermoplastic core for improved grip for knives, screwdrivers, and the like bladed tools. Such prior art constructions are disclosed in Sanelli, U.S. Pat. No. 4,712,304; Gakhar, U.S. Pat. No. 5,390,572; Hoepfl, U.S. Pat. No. 5,964,009; and Panaccione, U.S. Pat. No. 5,956,799.

Improvements in tool handle handles are disclosed in U.S. Pat. No. 6,471,186, granted Oct. 2, 2002 to Lawless, U.S. Pat. No. 6,772,994, granted Aug. 10, 2004 to Lawless, U.S. Pat. No. 7,293,331, granted Nov. 13, 2007 to Lawless and U.S. Pat. No. 8,032,991, granted Oct. 11, 2011 to Lawless (hereinafter the "Lawless patents"). The Lawless patents generally disclose symmetrically circumferentially disposed hard thermoplastic grip elements, and in combination with soft elastomeric grip elements. The Lawless patents' handles did not provide the desired ergonomic grip, particularly for diverse commercial uses for tools. It was known in the art to provide a screw driver handle with a triangular configuration having machinist rounded corners for tool bit stowage, as disclosed in U.S. Pat. No. 6,164,172, issued Dec. 26, 2001 to Huang.

It is a principal object of the present invention to provide tool handle of improved ergonomic functionality for diverse commercial uses.

It is a further object of the present invention to provide a tool handle as aforesaid with improved leverage or torque functionality.

It is a further object of the present invention to provide a tool handle as aforesaid with an improved impact end cap.

It is still a further object of the present invention to provide an ergonomic tool handle that is of practical design and safe and practical in commercial scale and use.

SUMMARY OF THE INVENTION

The invention, in a principal aspect, is a tool handle having a proximate end and a distal end and a grip portion disposed between the proximate end and the distal end, and the grip portion has a plurality of lobes and each lobe comprises an outwardly disposed arcuate or curved surface.

The invention, in a more specific aspect, is a tool handle as aforesaid, wherein the grip portion has three lobes spacedly disposed about 120°, and each said lobe has an arcuate surface that subtends an arc of at least 45° to about 90°, and preferably about 45° to 60° and most preferably about 60°.

The invention is a tool handle as aforesaid that includes a centerline, and the grip portion has an upper surface and a lower surface, and the grip portion has three lobes spacedly angularly disposed with respect to the centerline, and two lobes are disposed adjacent the upper surface and one lobe is disposed adjacent the lower surface.

The invention in a further aspect is a tool handle as aforesaid wherein a grip portion is disposed between the proximate end and the distal end, and more adjacent the proximate end and the grip portion has three lobes, each lobe has an arcuate surface that subtends an arc of at least 45° to at least about 90°, and a blade receiving centerline orifice of a polygonal configuration, particularly a rectilinear configuration. And the grip portion adjacent the proximate end has three generally planar surfaces, and each lobe extends outwardly from and between two of the generally planar surfaces, and wherein at least one right angle of the rectilinear configuration orifice is facingly disposed to one lobe or to one generally planar surface for improved torque functionality.

The invention in a still further aspect is a tool handle as aforesaid further including an end cap, and having means for fixedly disposing the end cap to the handle proximate end. The means for fixedly disposing the end cap is a plurality of outwardly extending pointed elements grippingly engaging the hard thermoplastic handle to prevent displacement of the end cap. The end cap may alternatively have outwardly extending proximately extending grip elements grippingly engaging the hard thermoplastic handle.

The invention, in a further aspect, is a tool handle end cap as an immediately aforesaid with a tang with through hole for securing a tether, and the tang is rotatably disposed with respect to the end cap, and slidably disposed between the end cap and the handle so that a tether disposed in the through hole and rotates with the tang in using the tool.

The invention, in still a further aspect is a tool handle as first aforesaid having a centerline, and the handle has an upper surface and a lower surface, and further includes a thumb engaging portion disposed at the neck between the grip portion and the distal end, and the thumb engaging portion has a plurality of ridges, the ridges having different lengths.

The invention, in still a further aspect, is a tool handle as immediately aforesaid with ridges disposed at the neck and being in parallel disposition with respect to the centerline, and further being disposed at the upper and lower surfaces of the neck.

The invention, in still a further aspect, is a tool handle as aforesaid with ridges being transversely disposed to the centerline, and the ridges extend from the upper surface to the lower surface. The tool handle as aforesaid is particularly a screwdriver handle.

The invention, in still a further aspect, is a striking tool sleeve handle wherein a distal end and a grip portion are disposed between the proximate end and the distal end, and the grip portion has a plurality of lobes, each lobe has an outwardly disposed curved surface, and handle having a plurality of generally planar surfaces, and also includes a polygonal through hole extending from the distal end to the proximate end for slidably receiving a polygonal striking tool. And the plurality of ridges or splines are disposed inwardly from the through hole generally planar surface for receiving the striking tool. And preferably said polygonal through hole comprises a regular hexagon, and each angle of the regular hexagon is facingly disposed to at least one lobe or one generally planar surface.

The invention, in yet a further aspect, is a metal end cap with outwardly radially disposed pointed ribs or alternatively outwardly proximately disposed pointed prongs, embedded and grippingly engaged in the core thermoplastic handle. A projecting element or tang with a tether receiving through hole is slidably rotatably disposed with respect to the end cap and handle proximate end.

DESCRIPTION OF THE PREFERRED EMBODIMENT

Figure 1:
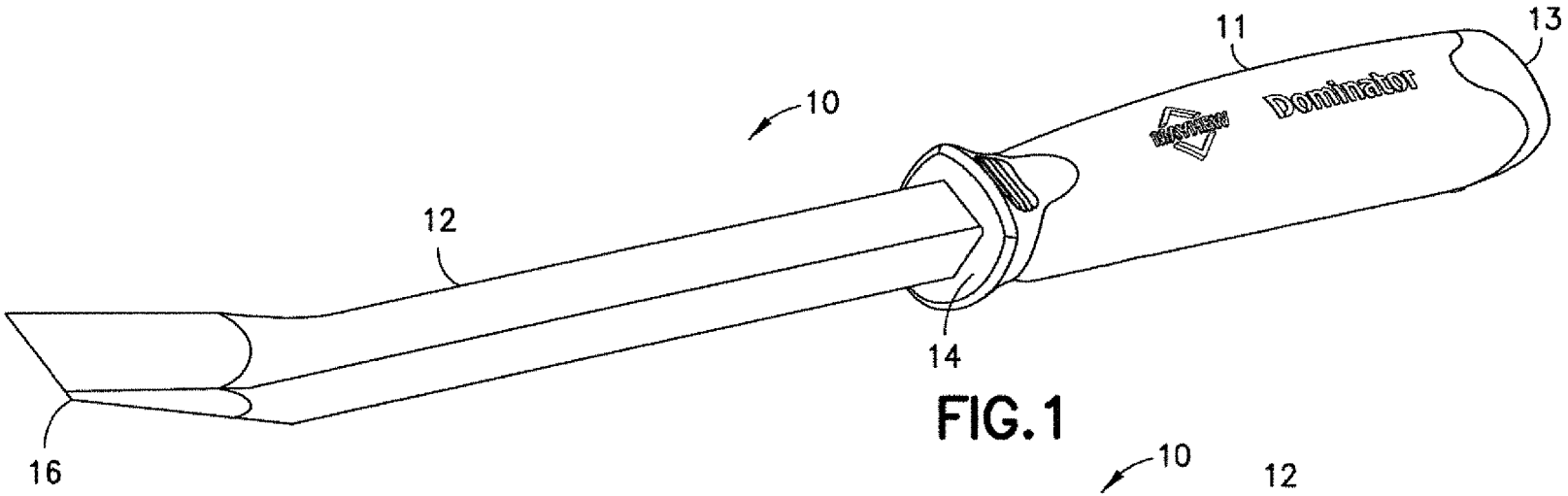
FIG. 1 is a top distal to proximate end perspective view of a first embodiment of the pry bar of the present invention.
Figure 2:
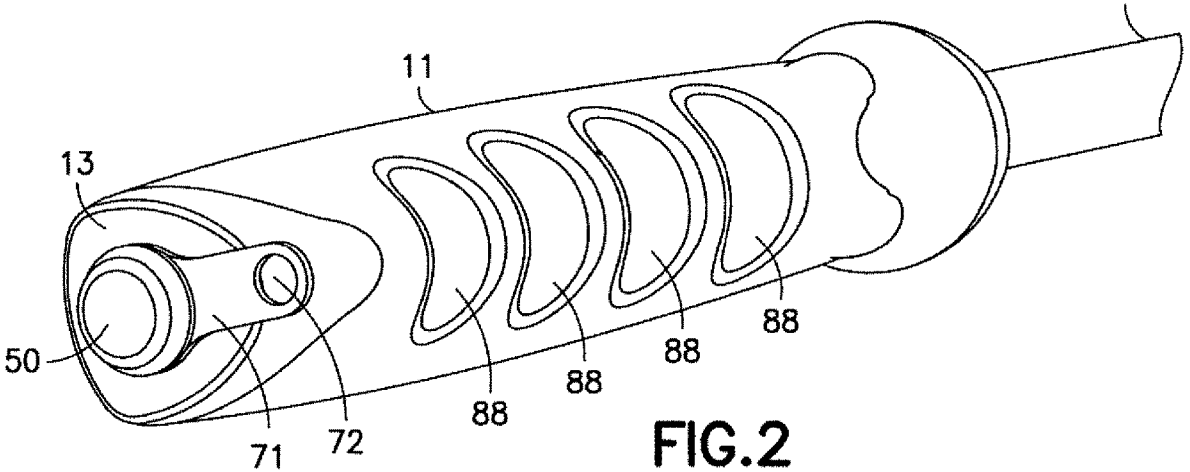
FIG. 2 is a bottom proximate to distal end prospective view of the tool handle of FIG. 1.
Figure 3:
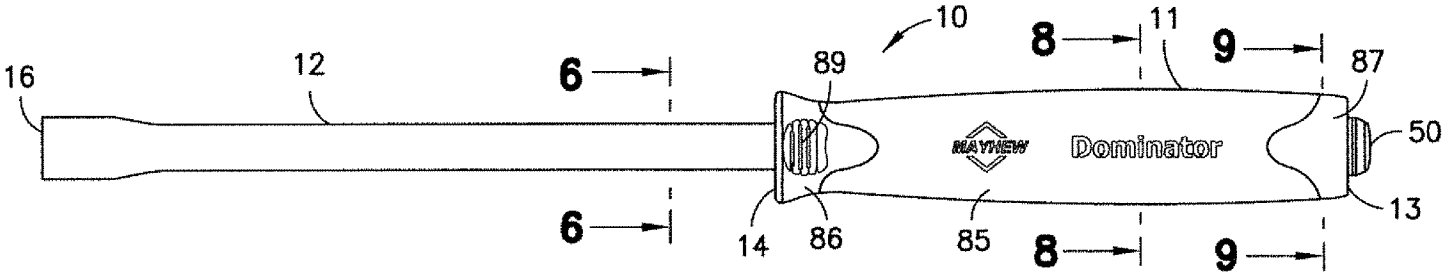
FIG. 3 is a top plan view of the tool handle of FIG. 1.
Figure 4:
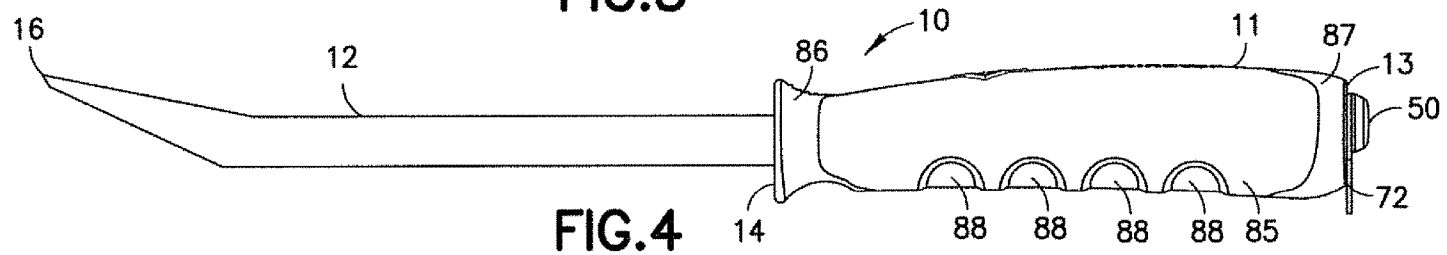
FIG. 4 is a side view of the tool handle as shown in FIG. 3.
Figure 6:
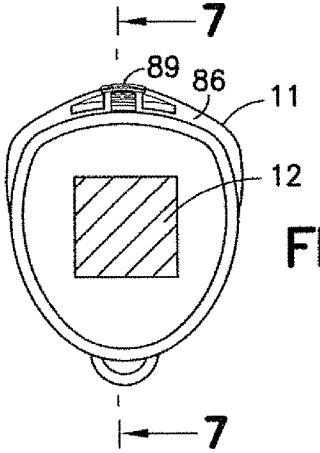
FIG. 6 is an enlarged sectional view taken along 6-6 of FIG. 3.
Figure 5:
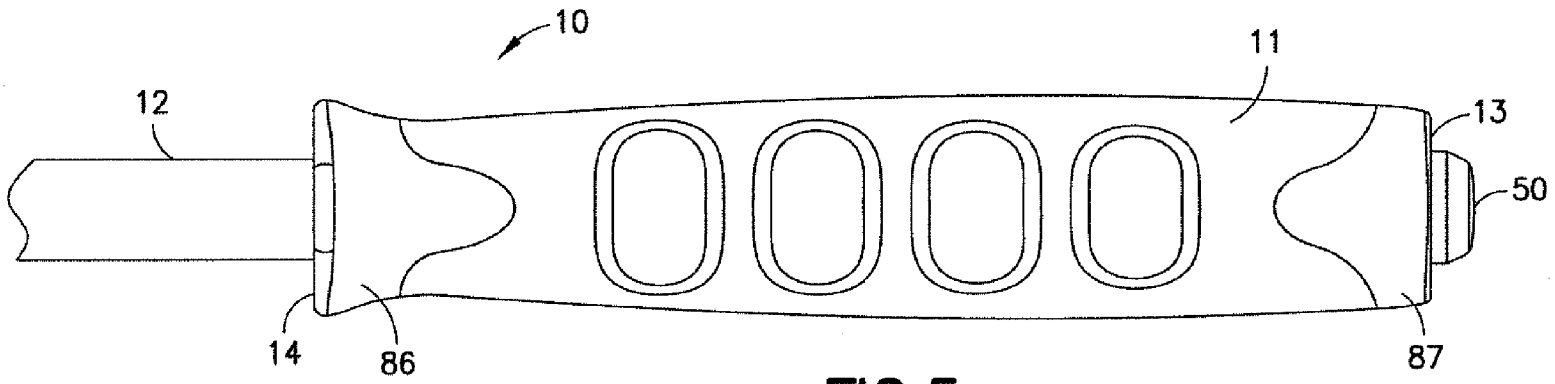
FIG. 5 is an enlarged bottom view of the tool handle as shown in FIG. 3.

Referring to FIGS. 1-9, there is shown a first embodiment pry bar 10 of the present invention. Pry bar 10, in general terms, includes handle 11 and a fixedly attached or secured metal blade or shank 12. Handle 11 has a planar proximate end 13 and a planar distal end 14. Blade 12 has a proximate end 15 (FIG. 7) and a distal end 16. Handle 11 is formed of a hard thermoplastic molded core 17 and a molded over integrally bonded elastomeric cover 18, wherein cover 18 is formed of relatively soft elastomeric material. The proximate end 15 of blade 12 is securely fixedly molded in core 17 rectilinear hole 91 with the formation of core 17. The elastomeric cover 18 is then molded over or around specific portions of the core 17, to provide a grip portion 95, as further discussed hereinafter. Blade 12 is of generally square cross-sectional bar stock construction and has a proximate end 15 and a distal end 16. Proximate end 15 is molded in situ with core 17, so as to be fixedly secured within handle 11, by means well known in the art.

A metal impact cap 50 is fixedly disposed or molded into the distal end of the handle 11. Cap 50 is secured within the handle core 17 by means well known in the thermoplastic molding art. Cap 50 is used, by way of example, to impact screw heads prior to driving same. The proximate end of core 17 is cooperatively formed with a serrated hole 92 for fixedly securing serrated portion 93 of metal cap 50 in the handle proximate end.

Blade distal end 16 is formed with a pry end 53. Pry end 53 has outwardly tapered sides 54, and upper and lower surfaces 56 and 57. Surfaces 56 and 57 are tapered and extend towards sharpened edge or tip 58. Tip 58 is upwardly angularly disposed with respect to shank 12.

Figure 7:
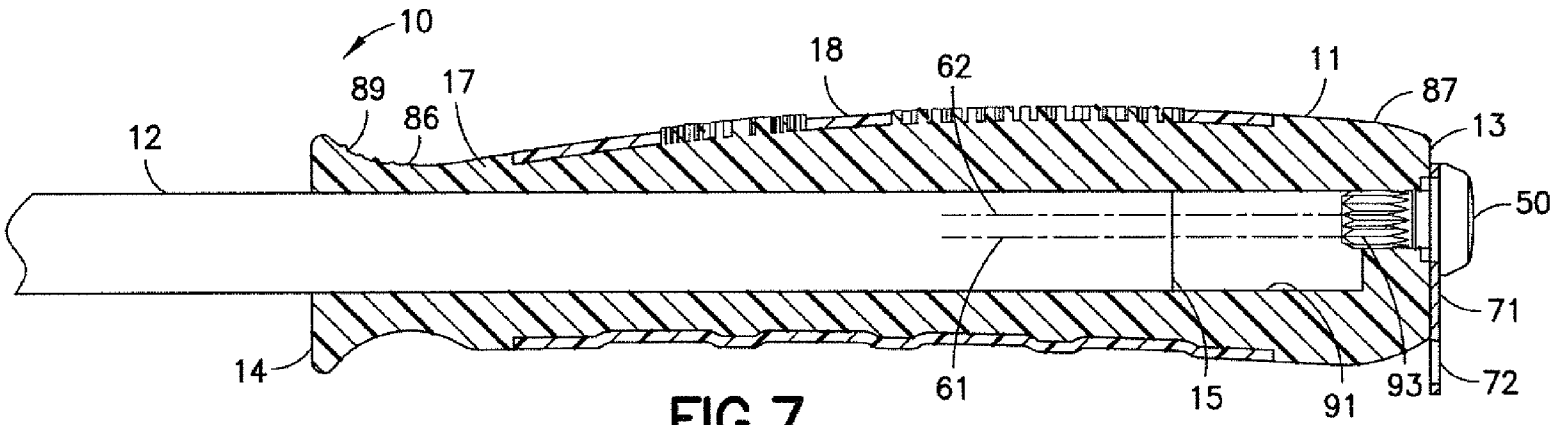
FIG. 7 is a sectional view taken along 7-7 of FIG. 6.
Figure 8:
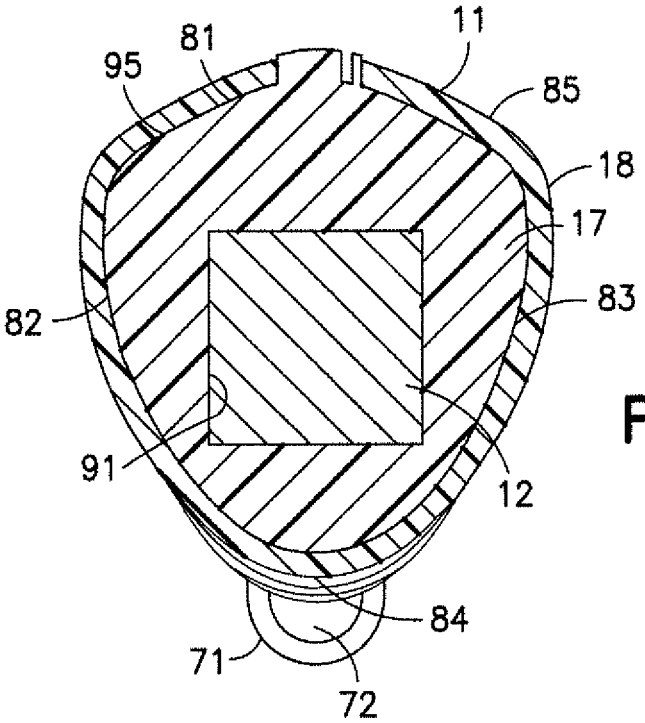
FIG. 8 is an enlarged sectional view taken along 8-8 of FIG. 3.
Figure 9:
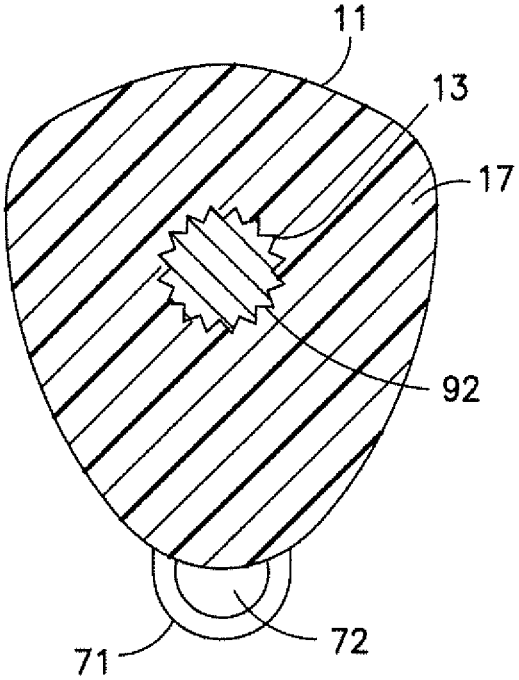
FIG. 9 is an enlarged sectional view taken along 9-9 of FIG. 3.
Figure 10:
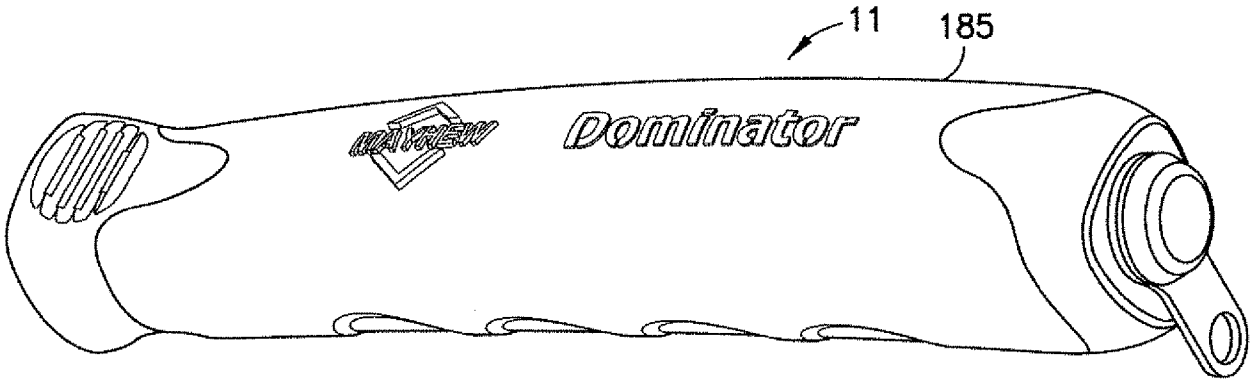
FIG. 10 is a perspective view of a second embodiment of the tool handle of the present invention.
Figure 11:
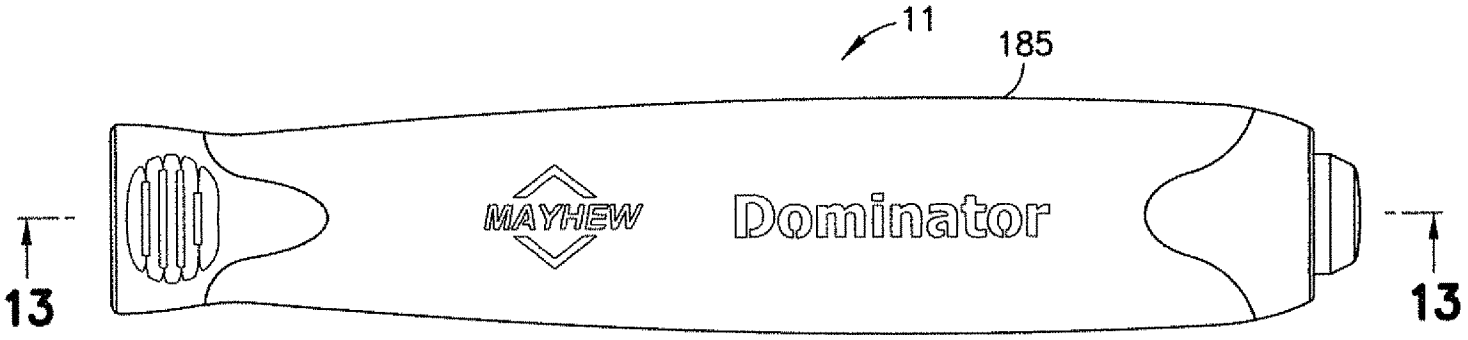
FIG. 11 is a top plan view of the tool handle of FIG. 10.
Figure 12:
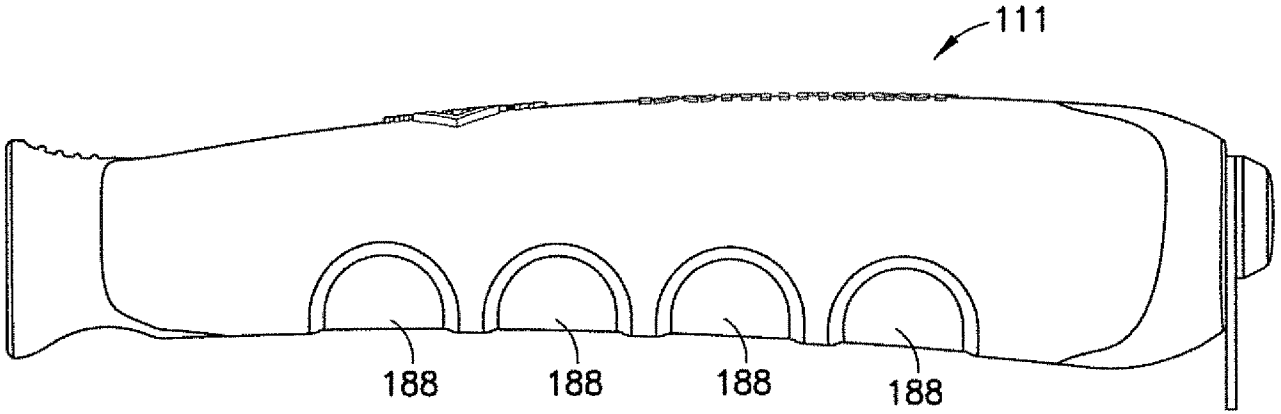
FIG. 12 is a side view of the tool handle of FIG. 11.
Figure 13:
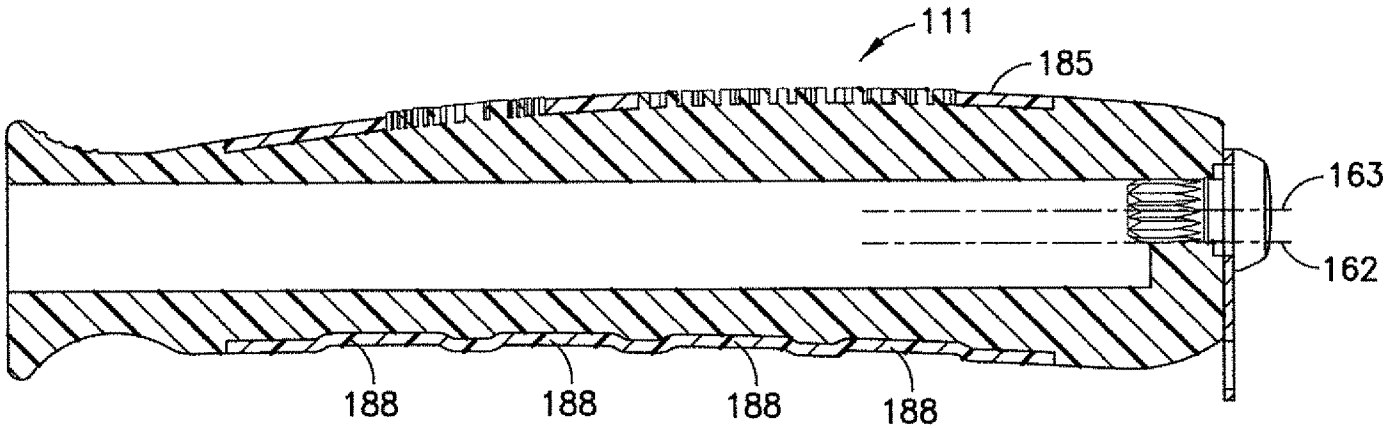
FIG. 13 is a sectional view taken along 13-13 of FIG. 11.
Figure 14:
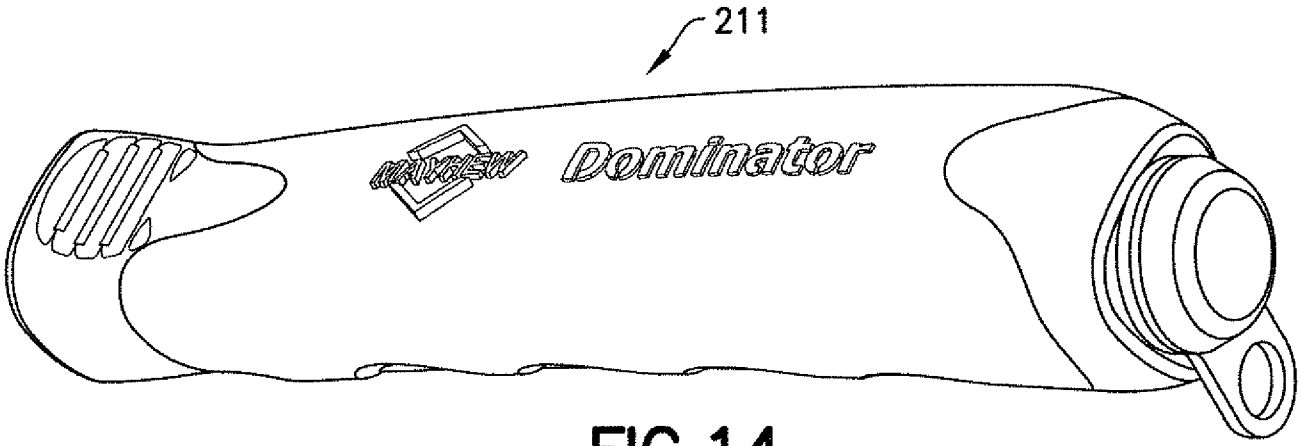
FIG. 14 is a perspective view of a third embodiment of the tool handle.
Figure 15:
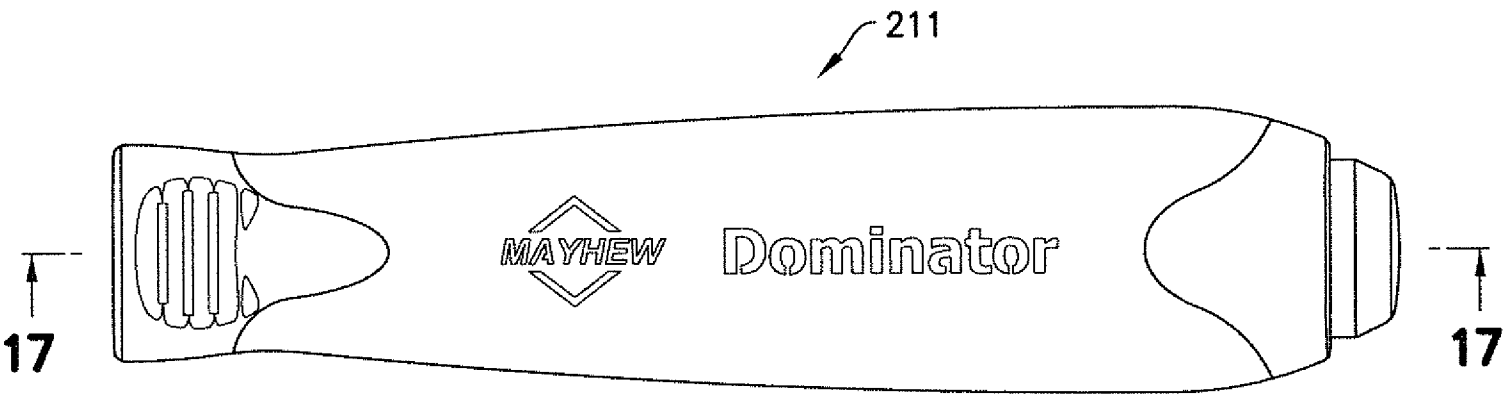
Figure 16:
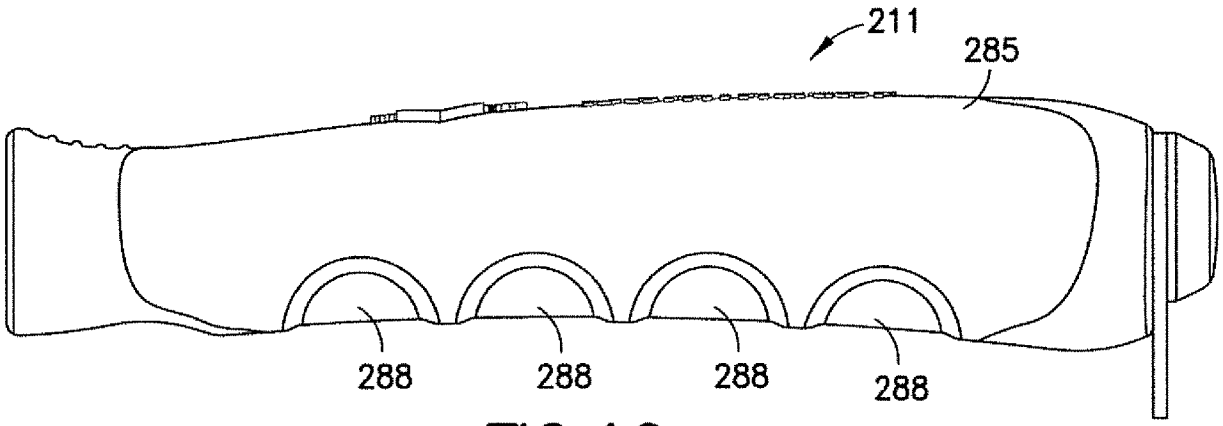
FIG. 16 is a side view of the tool handle of FIG. 15.
Figure 17:
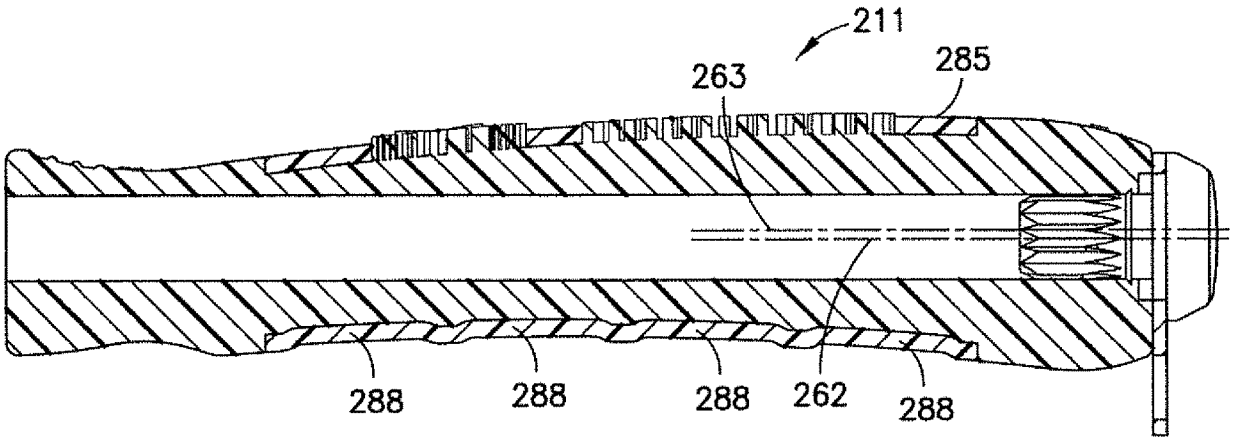
FIG. 17 is a sectional view taken along 17-17 of FIG. 15.
Figure 18:
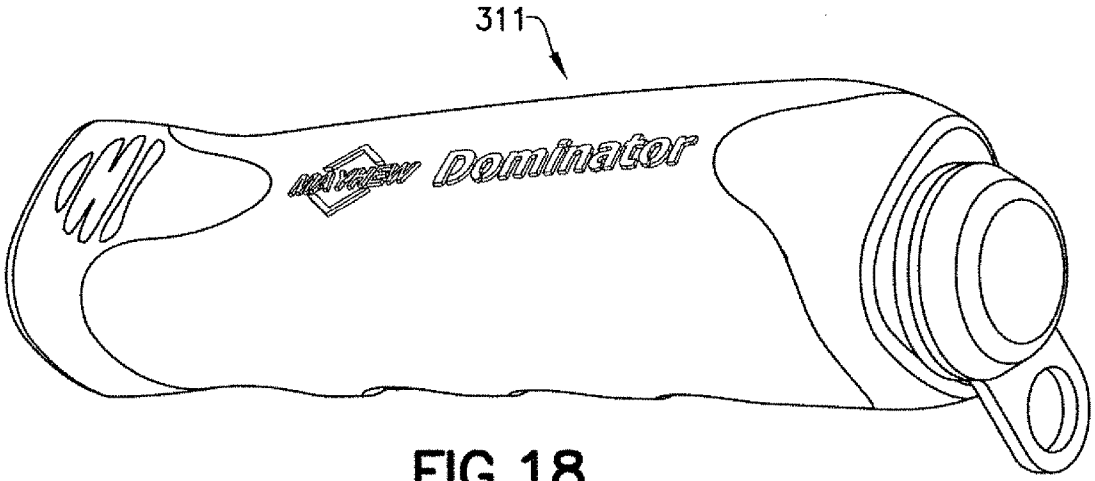
FIG. 18 is a perspective view of a fourth embodiment of the tool handle of the present invention.
Figure 19:
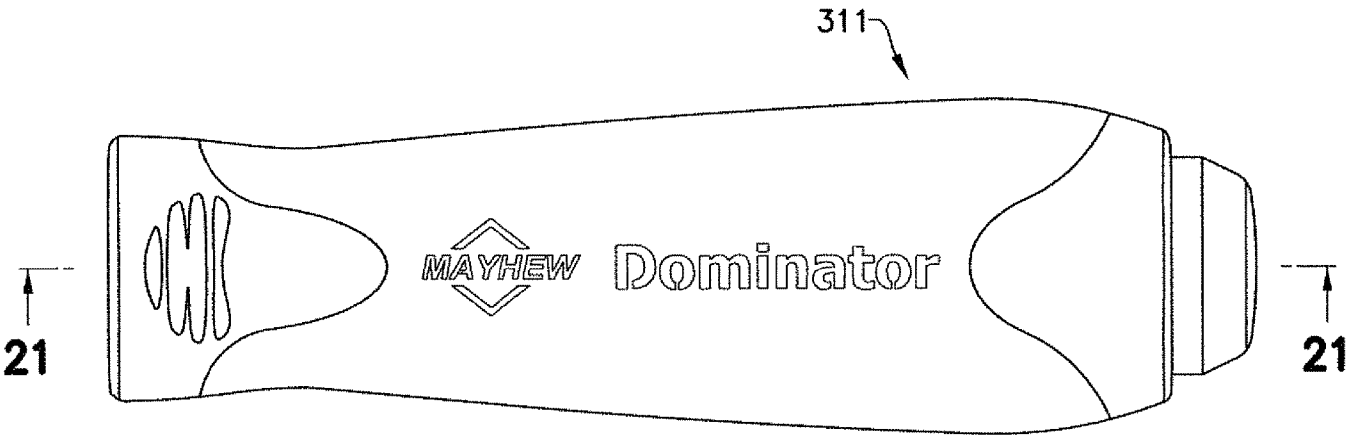
FIG. 19 is a top plan view of the tool handle of FIG. 18.
Figure 20:
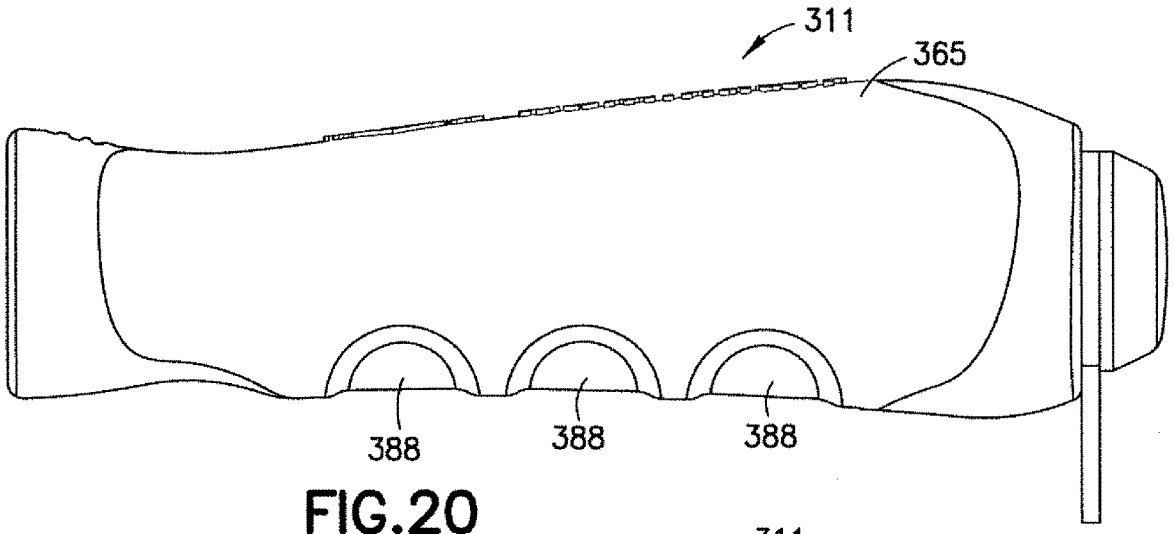
FIG. 20 is a side view of the tool handle of FIG. 19.

The elastomeric material cover 18 does not cover the entire core 17. Elastomeric material cover 18 is molded over hard thermoplastic core 17 peripherally in the triangular sectional shaped handle grip portion 95. Generally triangularly shaped cross-section grip portion 95 is formed of the upper or top upwardly cured first surface 81, and outwardly curved side surfaces 82 and 33, with bottom curved portion or apex 84 (FIG. 8). The grip portion 95 is over-molded as at 85 by elastomeric material so as to essentially surround the thermoplastic core at the grip portion. The respective distal 85 and proximate 87 thermoplastic core portions are exposed and not over-molded (FIGS. 3-7).

A series of four transversely disposed oval recesses 88 (typical) are formed at the bottom curved portion 84 and extend upwardly along the sides of over-molded elastomeric grip portion 85. The oval elastomeric recesses 88 extending upwardly from apex 84 and provide improved finger gripping functionality. Three to four elastomeric encompassed grip oval finger receiving recesses are provided commensurate with the length of the handle.

A series of parallel outwardly extending ridged elements 89 is formed in the upper exposed hand thermoplastic core to provide a thumb receiving and holding recess, in combination with the finger receiving oval recesses 88, for improved ergonomic grip.

A metal tang 71 with tether hole 72 is rotatably disposed between metal impact cap 50 and handle planar proximate end 13, as further discussed hereinafter.

Handle 11 is formed with centerline 61, and metal impact cap is formed with axis or centerline 62. As best shown in FIG. 7, the centerlines 61 and 62 are spatially disposed or offset in the side elevational direction. The spatial disposition provides improved impact cap functionally in using the impact cap for heavy-duty diverse impact for use, and as further discussed hereinafter with respect to the embodiments of FIGS. 10-21.

Referring to FIGS. 10-13, there is shown a second embodiment handle 111. Handle 111 is more elongated than handle 11. The handle centerline 162 is offset or spatially disposed from end cap centerline in axis 163 to a greater extent (FIG. 13) than lines 62 and 63. Handle 111 has the triangularly shaped sectional elastomeric grip portion 185 similar to that of first embodiment grip portion 85, with four oval finger receiving recesses 188 (typical).

Referring to FIGS. 14-17, there is shown a third embodiment handle 211. Handle 211 is somewhat less elongated than handle 111. The handle centerline 252 is offset or spatially disposed from end cap centerline or axis 263 to a lesser degree (FIG. 17) than centerlines 162 and 163 of the second embodiment. Handle 211 is formed with elastomeric triangular grip portion 285 with four oval finger receiving recesses 288 (typical), similar to that of embodiment 111.

Figure 21:
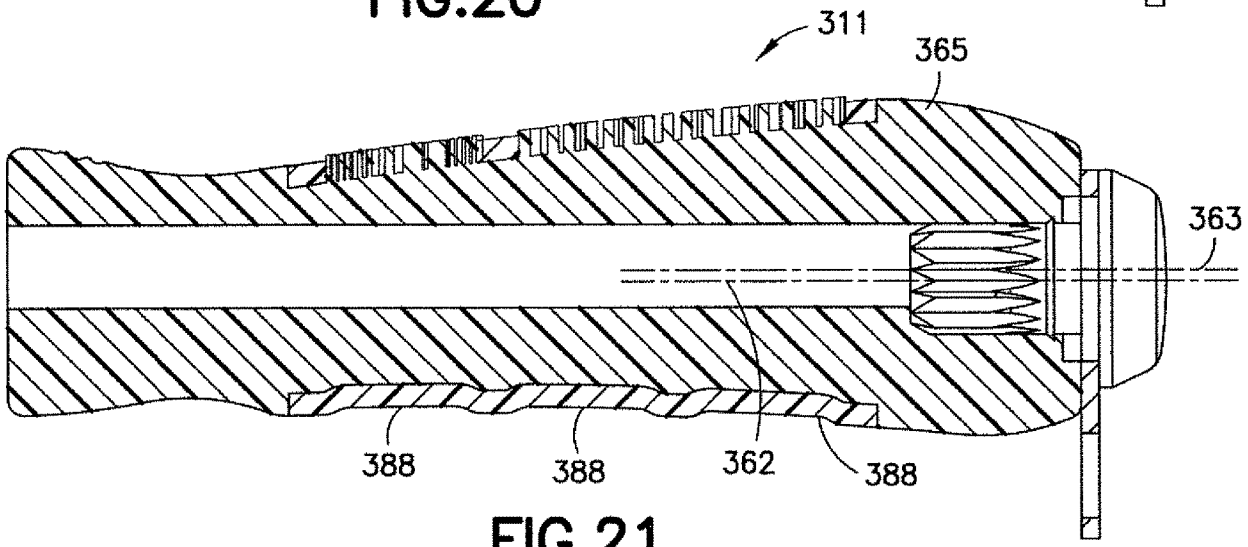
FIG. 21 is a sectional view of the tool handle taken along 21-21 of FIG. 19.
Figure 22:
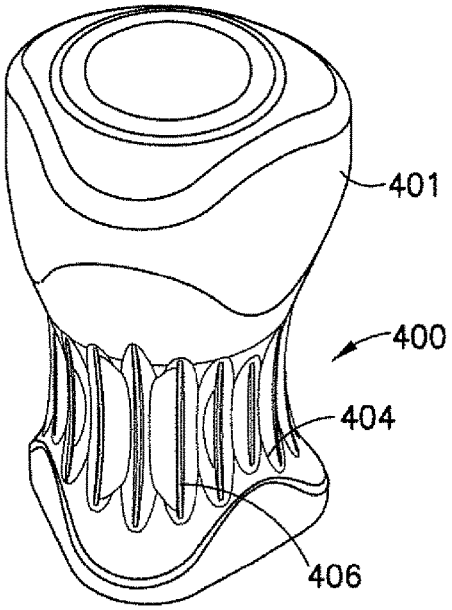
FIG. 22 is a front perspective view of the stubby or awl handle embodiment.
Figure 23:
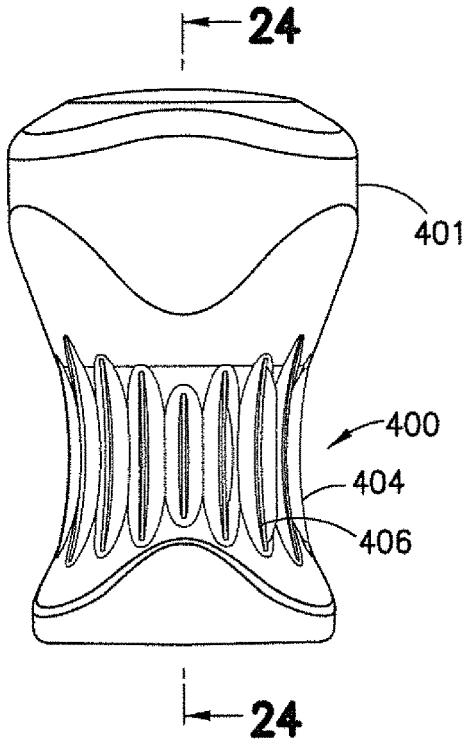
FIG. 23 is a side elevational view of the embodiment of FIG. 22.
Figure 24:
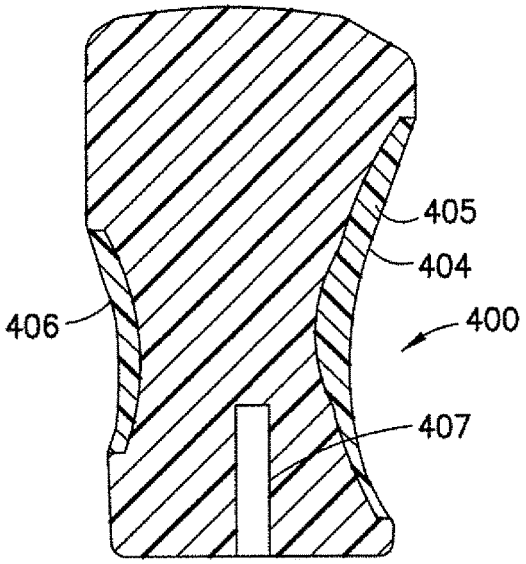
FIG. 24 is a sectional view taken along 24-24 of FIG. 23.
Figure 25:
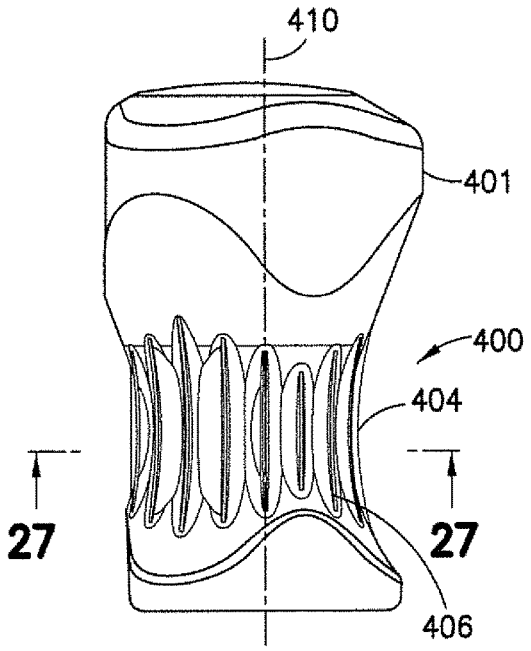
FIG. 25 is another side elevational view of the embodiment of FIG. 22.
Figure 26:
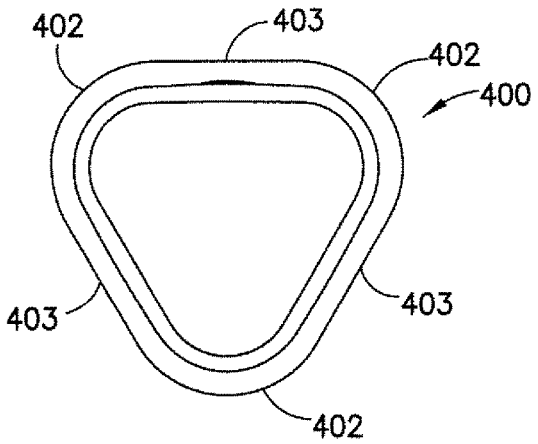
FIG. 26 is a distal end view of the embodiment of FIG. 22.
Figure 27:
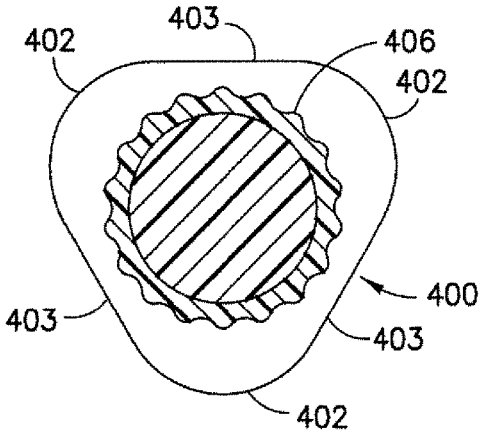
FIG. 27 is a sectional view taken along 27-27 of FIG. 25.
Figure 28:
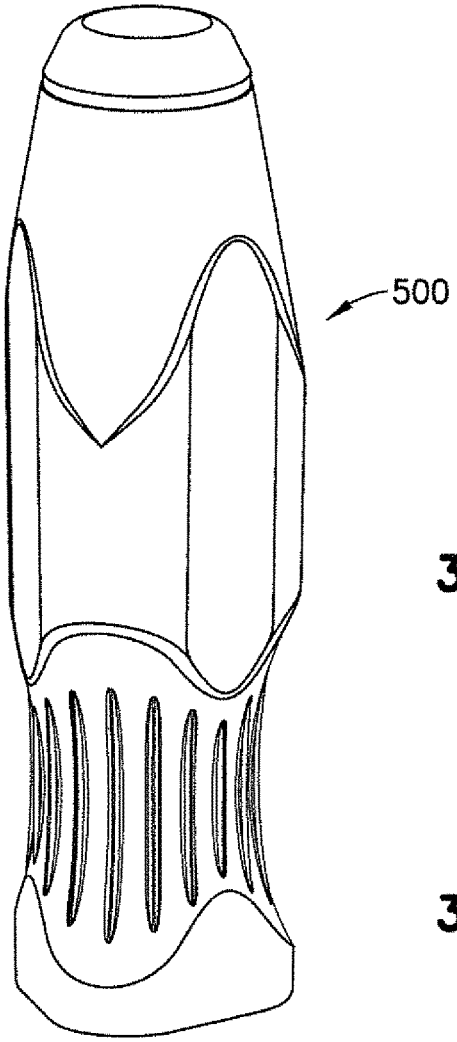
FIG. 28 is a front perspective view of the screwdriver technician handle embodiment.
Figure 29:
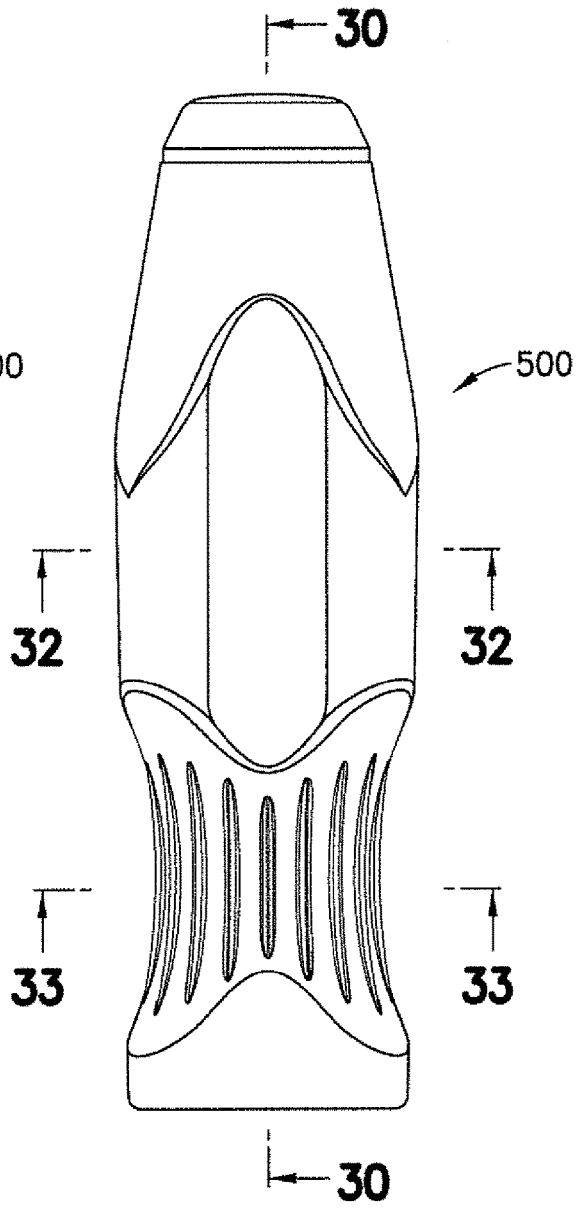
FIG. 29 is a side elevational view of the embodiment of FIG. 28.
Figure 30:
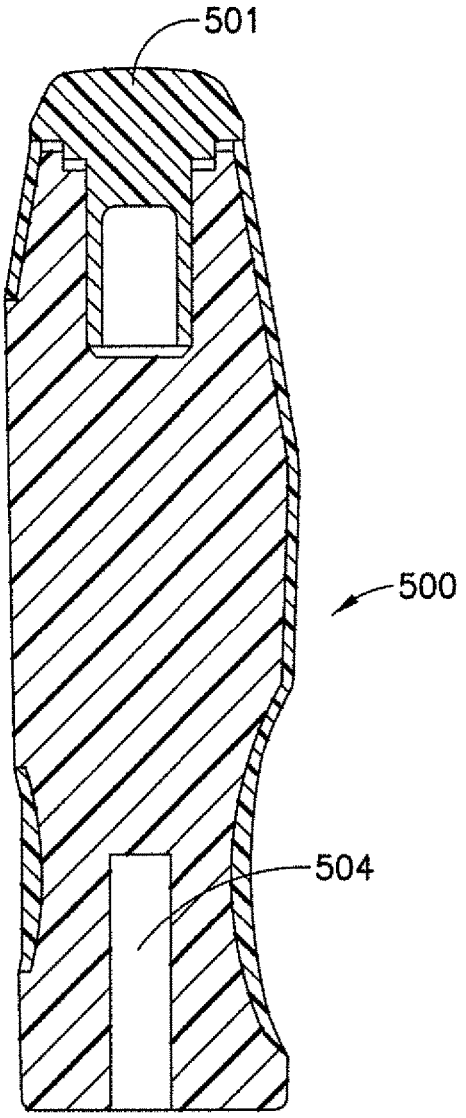
FIG. 30 is a sectional view taken along 30-30 of FIG. 29.
Figure 31:
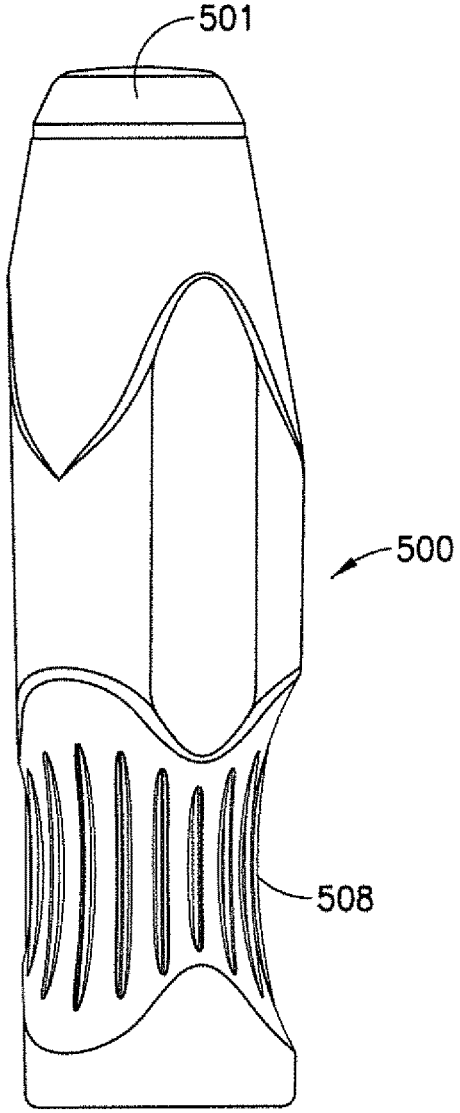
FIG. 31 is another side elevational view of the embodiment of FIG. 28.
Figure 35:
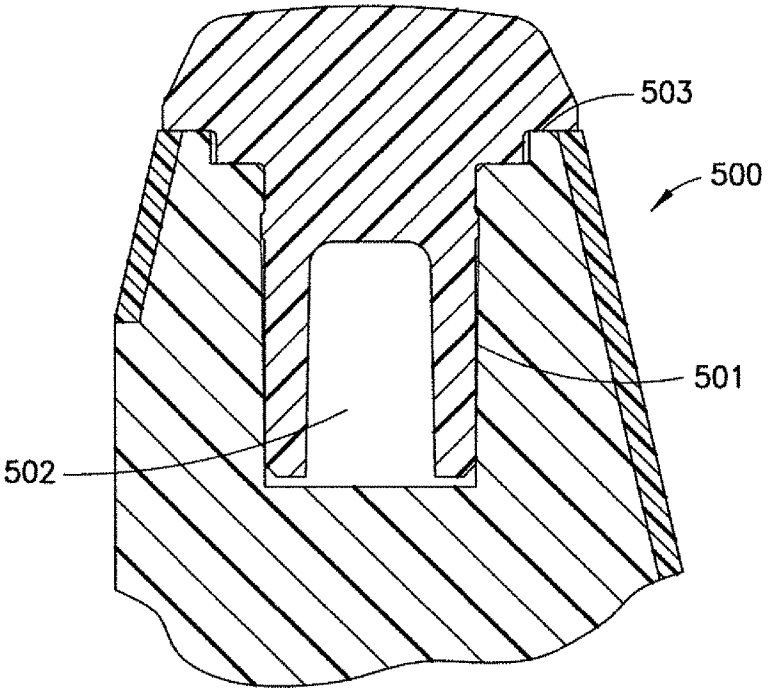
FIG. 35 is an enlarged view of the end cap construction as shown in FIG. 28.
Figure 32:
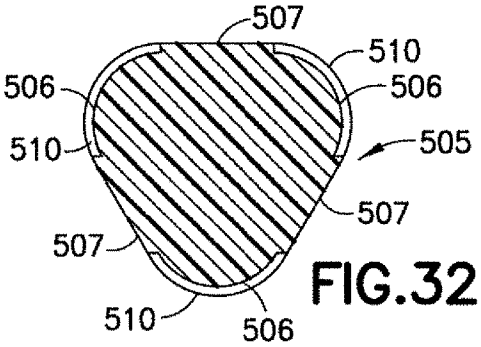
FIG. 32 is a sectional view taken along 32-32 of FIG. 29.
Figure 33:
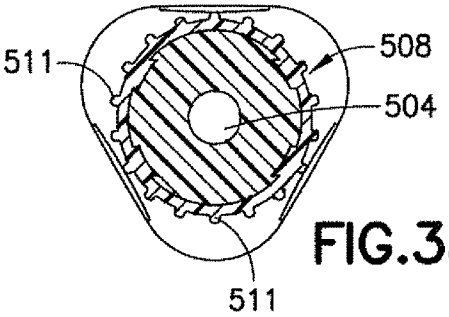
FIG. 33 is a sectional view taken along 3-33 of FIG. 29.
Figure 34:
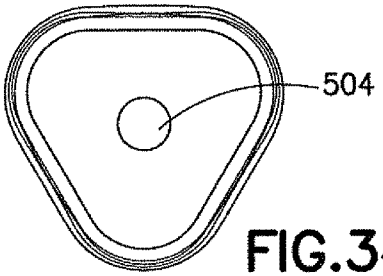
FIG. 34 is a distal end view of the embodiment of FIG. 28.
Figure 36:
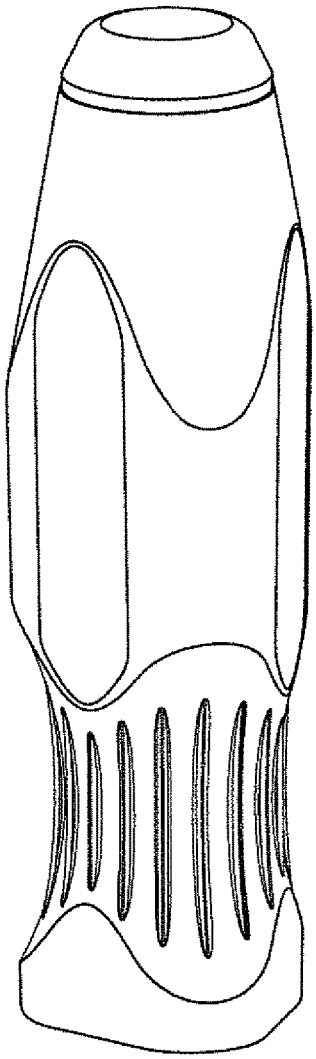
FIG. 36 is a front perspective view of a screwdriver mechanic handle embodiment.
Figure 37:
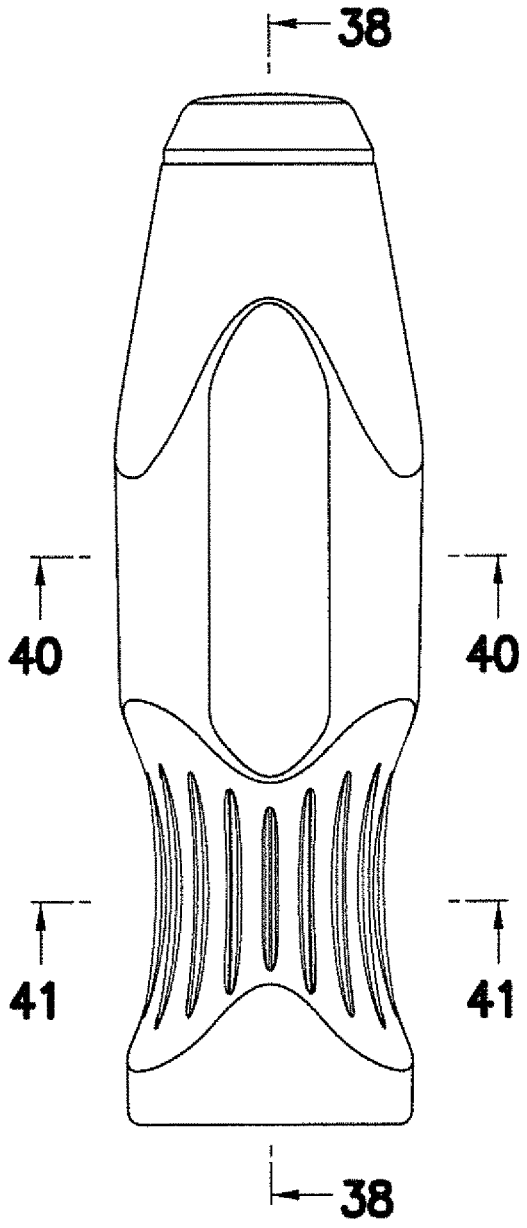
FIG. 37 is a side elevational view of the embodiment of FIG. 36.
Figure 38:
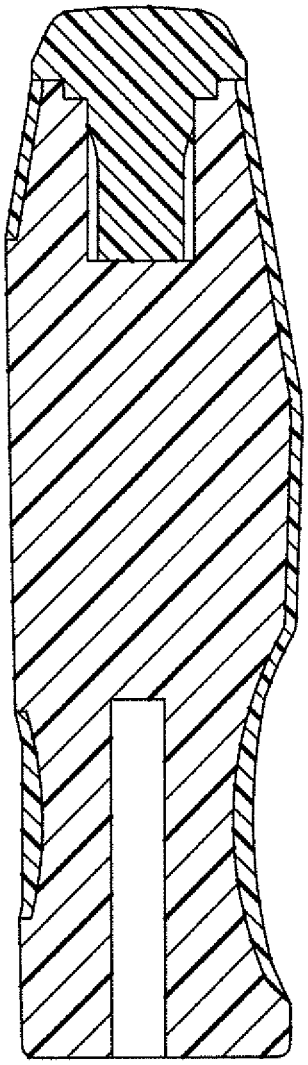
FIG. 38 is a sectional view taken along 38-38 of FIG. 36.
Figure 39:
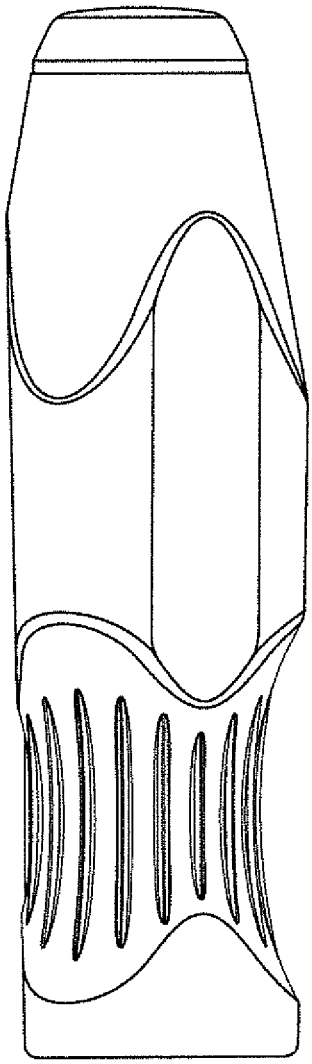
FIG. 39 is another side elevational view of the embodiment of FIG. 36.
Figure 43:
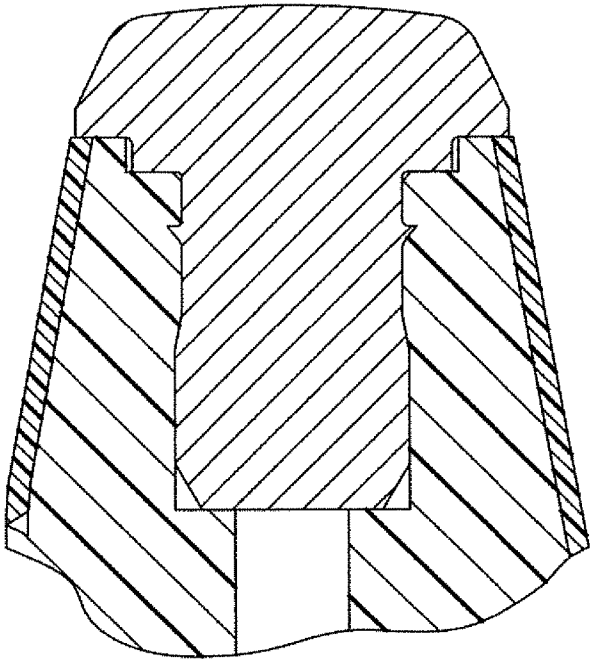
FIG. 43 is an enlarged view of the end cap construction as shown in FIG. 38.
Figure 40:
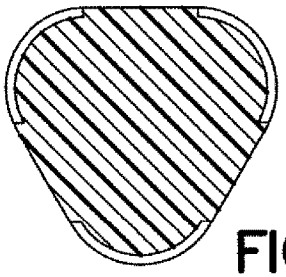
FIG. 40 is a sectional view taken along 40-40 of FIG. 36.
Figure 41:
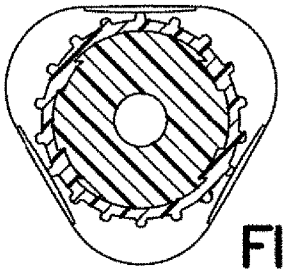
FIG. 41 is a sectional view taken along 41-41 of FIG. 36.
Figure 42:
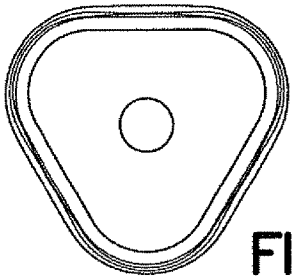
FIG. 42 is a distal end view of the embodiment of FIG. 36.
Figure 44:
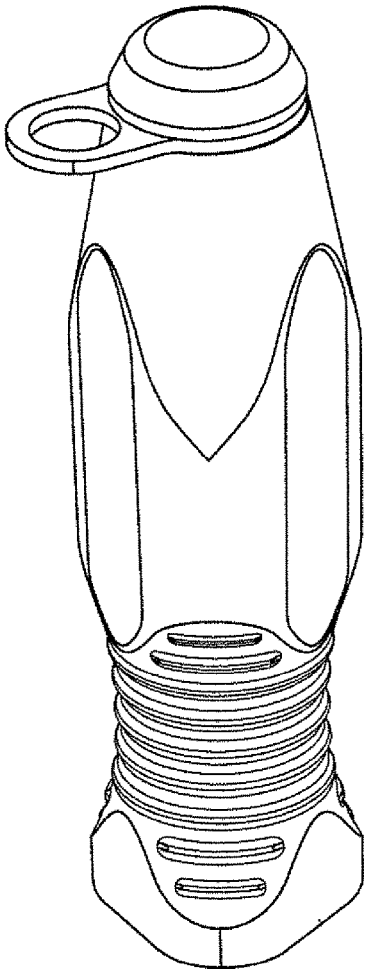
FIG. 44 is a front perspective view of the technical tool handle embodiment.
Figure 45:
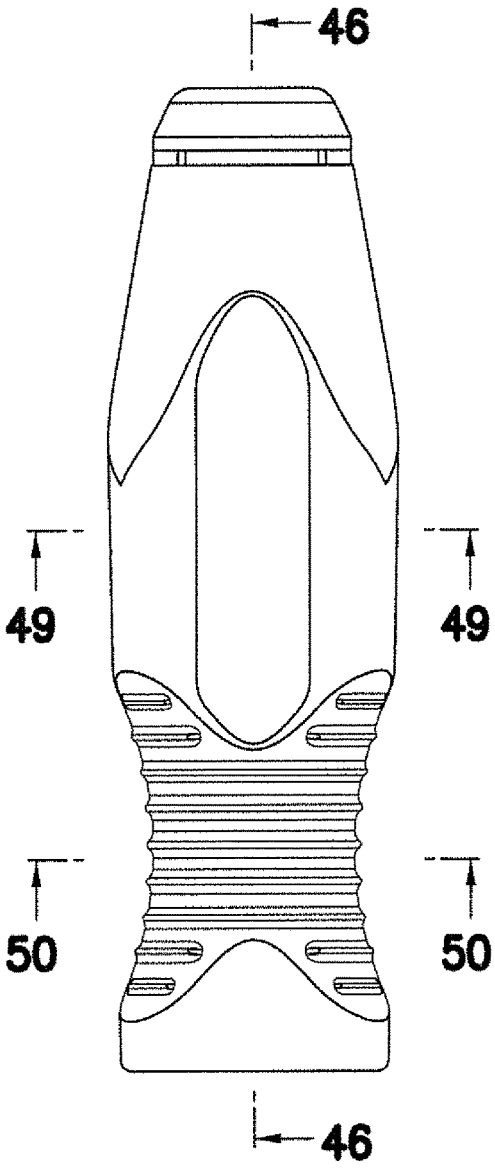
FIG. 45 Is a side elevational view taken along 45-45 of FIG. 44.
Figure 46:
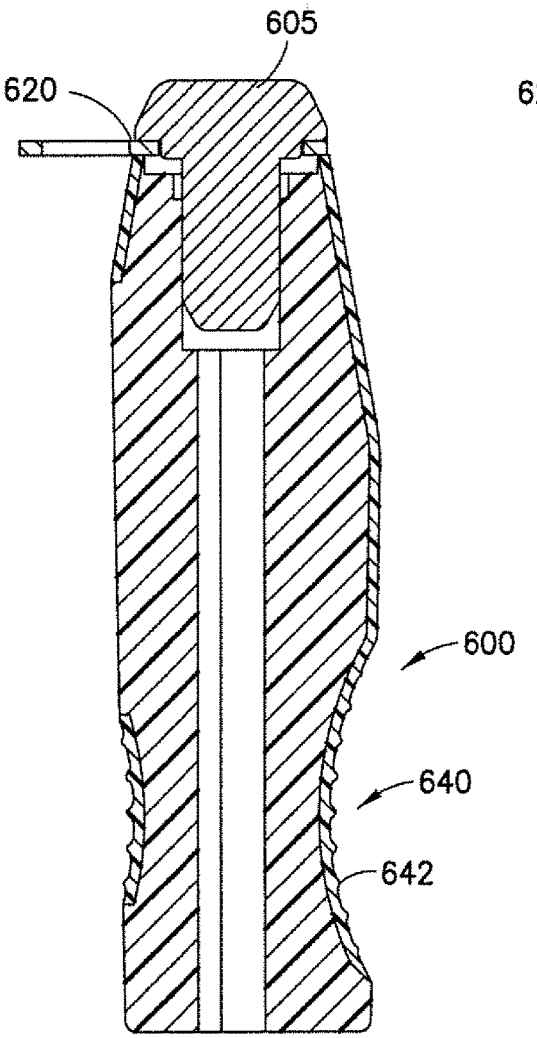
FIG. 46 is a sectional view taken along 46-46 of FIG. 45.
Figure 47:
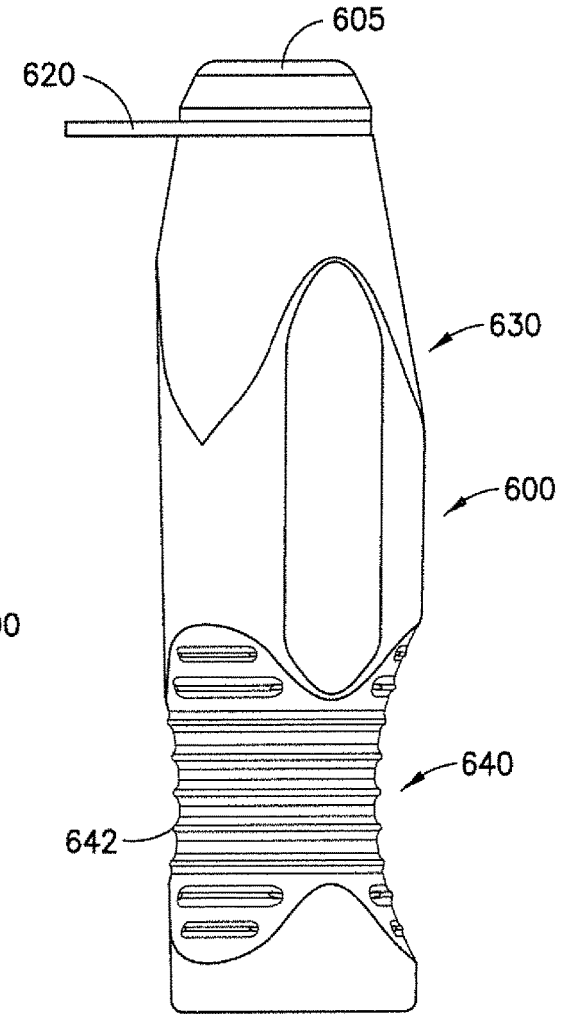
FIG. 47 is another side elevational view of the embodiment of FIG. 44.
Figure 48:
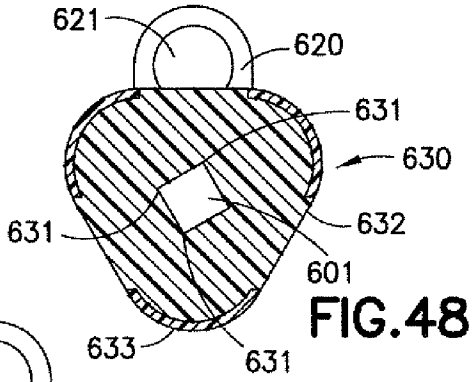
FIG. 48 is a sectional view taken along 48-48 of FIG. 44.
Figure 49:
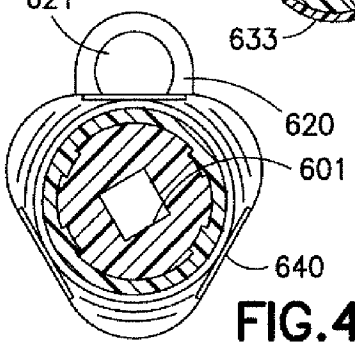
FIG. 49 is a sectional view taken along 49-49 of FIG. 44.
Figure 50:
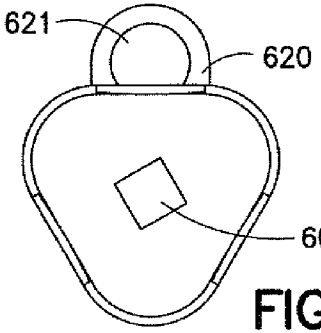
FIG. 50 is a distal end view of the embodiment of FIG. 44.
Figure 51:
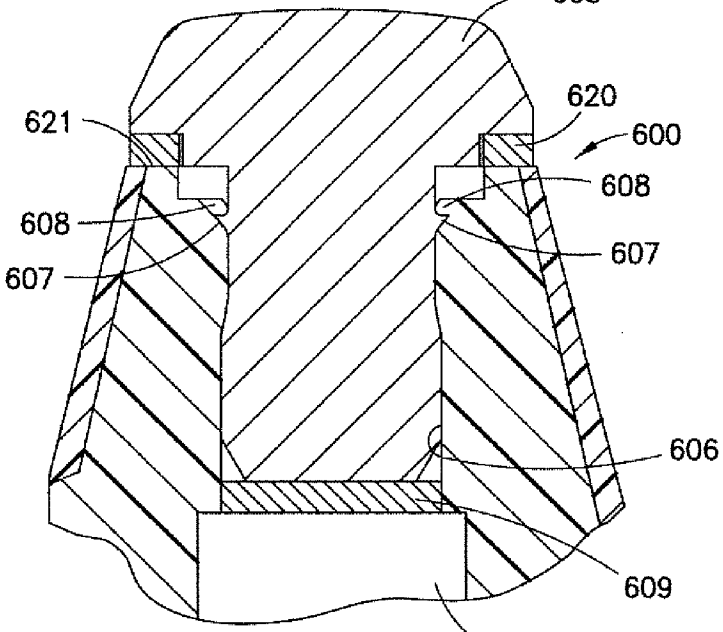
FIG. 51 is an enlarged view of the end cap construction as shown in FIG. 46.
Figure 52:
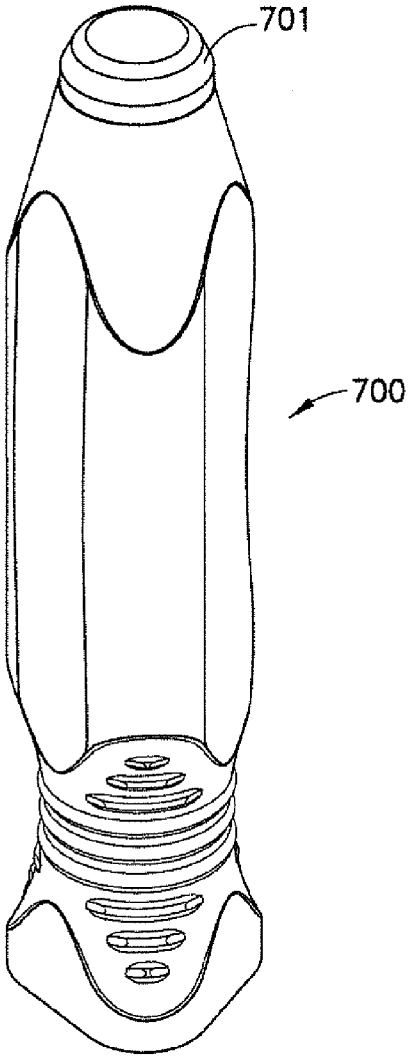
FIG. 52 is a perspective view of a further embodiment of the tool handle.
Figure 53:
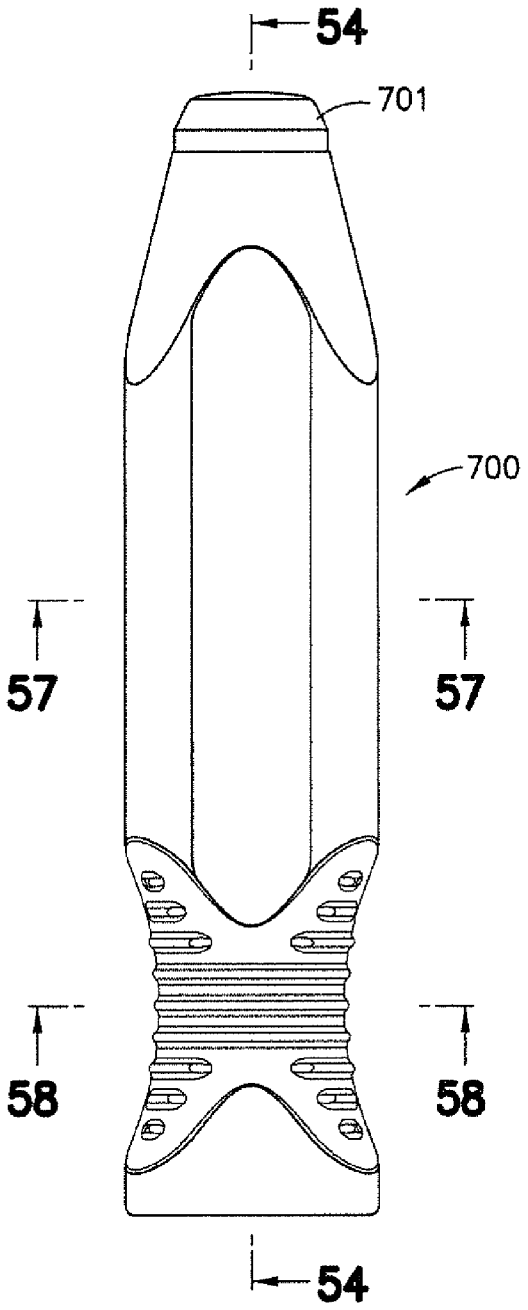
FIG. 53 is an elevational view of the tool handle of FIG. 52.
Figure 54:
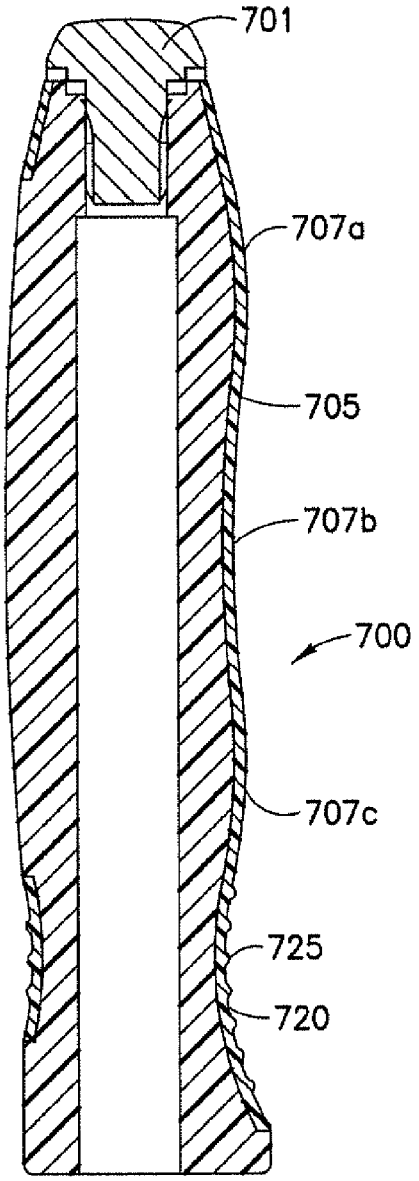
FIG. 54 is a sectional view taken along the line 54-54 of FIG. 52.
Figure 55:
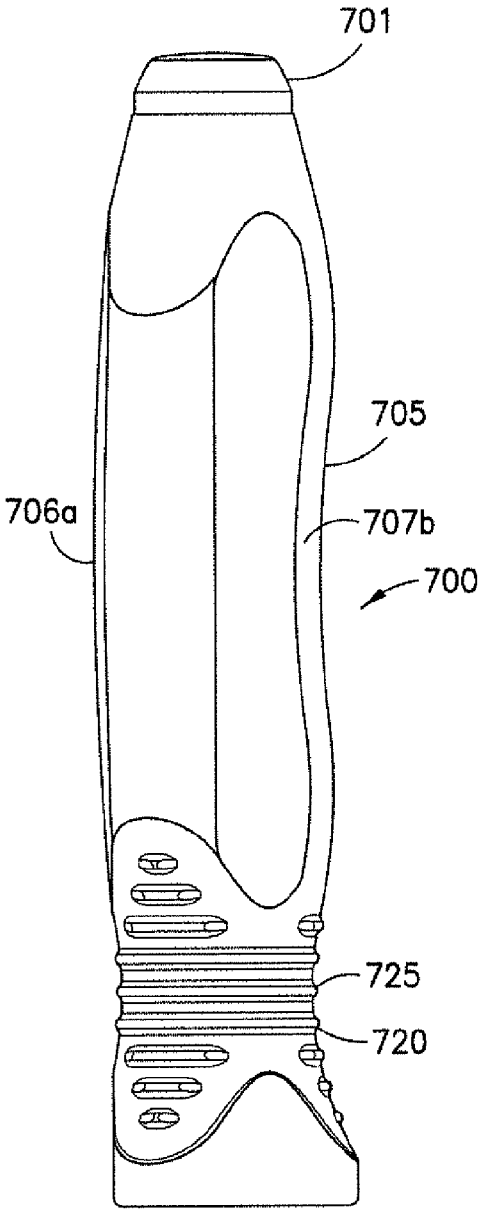
FIG. 55 is a side elevational view of the tool handle of FIG. 53.
Figure 56:
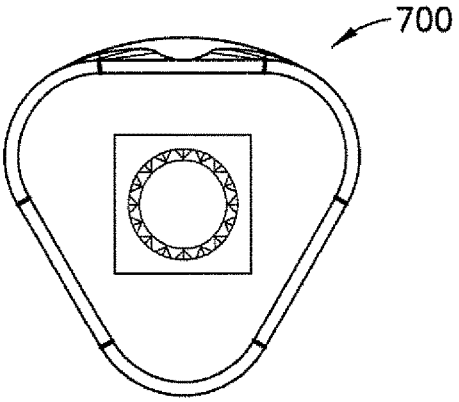
FIG. 56 is a distal end view of the tool handle of FIG. 53.

Referring to FIGS. 18-21, there is shown a further embodiment handle 311. Handle 311 is substantially less elongated than the prior embodiments. The handle 311 centerline 362 and end cap centerline or axis 363 are slightly offset and nearly coincident (FIG. 21). Handle 311 elevational triangular grip portion 365 is similar to that of the prior embodiment. However, handle 311 has only three oval finger receiving recesses 388, and yet in this shorter compact embodiment provides an improved ergonomic grip.

As demonstrated in FIGS. 1-21, the vertical spatial disposition between the handle centerline and the end cap centerline or axis is commensurately proportioned to the length of the handle. This end cap and grip portion disposition, and in further combination with the generally triangular grip portion, provides improved grip functionally in both the pry bar and end cap operational modes.

Referring to FIGS. 22-27, there is shown a stubby or awl embodiment of the present invention, namely handle 400. Handle 400 has a trilobular proximate end grip portion 401. Grip portion 401 has three lobes 402 that subtend an arc of about 60°, and three generally planar surfaces 403 disposed between the lobes 402. Handle 400 has a neck having distal end grip or thumb receiving portion 404. Grip portion 404 is over molded with elastomeric material as at 405. Grip portion 404 is formed of a plurality of elongate outwardly disposed ridges 406 of increasing and decreasing lengths. Ridges 406 are in parallel disposition with centerline 416. The proximate end of handle 400 is formed with orifice 407 for receiving an awl blade or screwdriver blade (not shown). In this manner of construction, handle 400 provides improved ergonomic grip and torque functionality in tight operating environments.

Referring to FIGS. 28-35, there is shown screwdriver technician handle 500. Handle 500 has a hard thermoplastic molded end cap 501. End cap 501 is press fitted into recess 502 at proximate end 503. End cap 501 is of removable construction and may be color coded to signify the functionality of the blade (not shown) disposed in distal end orifice 504. Proximate end grip portion 505 is of trilobular configuration composed of three lobes 502, and each lobe subtends an arc of about 60°. And three generally planar surfaces 507 are disposed between the lobes 502. Lobes 502 are over molded with elastomeric material as at 510. Distal end grip portion 508 is composed of radially disposed ridges 511 of similar configuration to embodiment 400.

Referring to FIGS. 36-43, there is shown a heavy duty screwdriver embodiment handle 550. Handle 550 is of similar construction and configuration as to embodiment 500. Handle 550 has a metal end cap 560. End cap 560 is forced fitted into recess 561. End cap 560 includes a plurality of radially disposed pointed elements or prongs 570 which are curved and extend towards the proximate end so as to grippingly engage the core as at 571. In this manner of construction, the end cap is not displaced along the centerline 575 in using the tool. Proximate and distal grip portions 580 and 590 of embodiment 550 are of similar construction to embodiment 500.

Referring to FIGS. 44-51, there is shown a pry bar technician handle 600 embodiment. Handle 600 is formed with a distal end rectilinear orifice 601 for receiving a rectilinear pry bar blade (FIGS. 3-6). Handle 600 has a metal end cap 605 which is forced fitted and fixedly disposed in recess 606. End cap 605 is formed with a radially disposed pointed prongs 607 for grippingly engaging the core as at 608. A spacer 609 is disposed between fixedly disposed end cap distal end and the proximate end of the rectilinear pry bar blade, for purposes hereinafter appearing. An outwardly extending plate or tang 620 is slidably disposed between the end cap 605 and handle proximate end. Tang 620 is formed with through hole 621 for receiving a lanyard or tether (not shown). Spacer 609 is sized so that tang 620 is slidably rotatably disposed with respect to the end cap. In this manner of construction, a tether or lanyard is looped and held in through hole 621 and consequentially rotates and moves freely with operation of the pry bar or like tool.

Proximate end grip portion 630 is of similar construction and configuration as in handle 500. The right angled corners 631 of rectilinear orifice 601 are facingly disposed to one of the generally planar surfaces 632 and one of the arcuate lobes 633 for improved force transmission.

Distal end grip portion 640 is formed with a plurality of ridges 641 of diverse lengths in transverse and parallel disposition. Ridges 641*a* at neck 642 extend around and encompass the circumference of neck 642. Ridges 641*b* are arcuate. In this manner of construction, there is improved leverage force transmission from the grip portions 630 and 640 to the pry bar blade (FIGS. 3-6).

Figure 57:
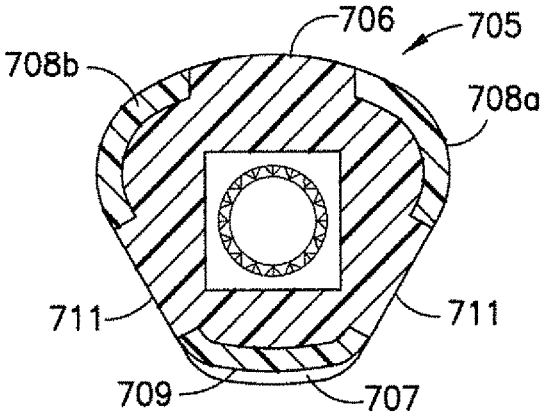
FIG. 57 is a sectional view taken along line 57-57 of FIG. 53.
Figure 58:
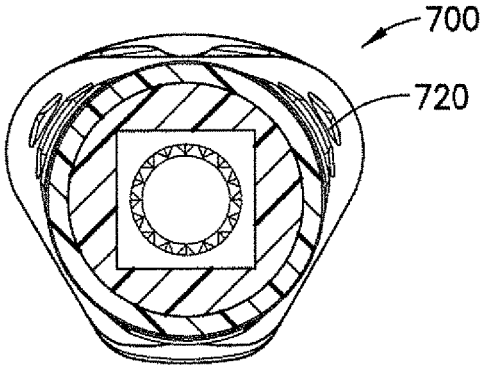
FIG. 58 is a sectional view taken along line 58-58 of FIG. 53.
Figure 59:
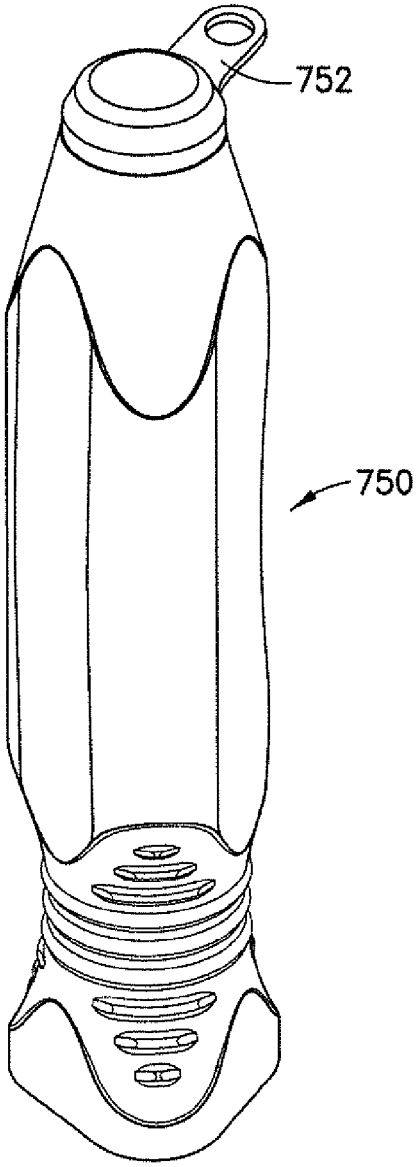
FIG. 59 is a perspective view of a further embodiment of the tool handle.
Figure 60:
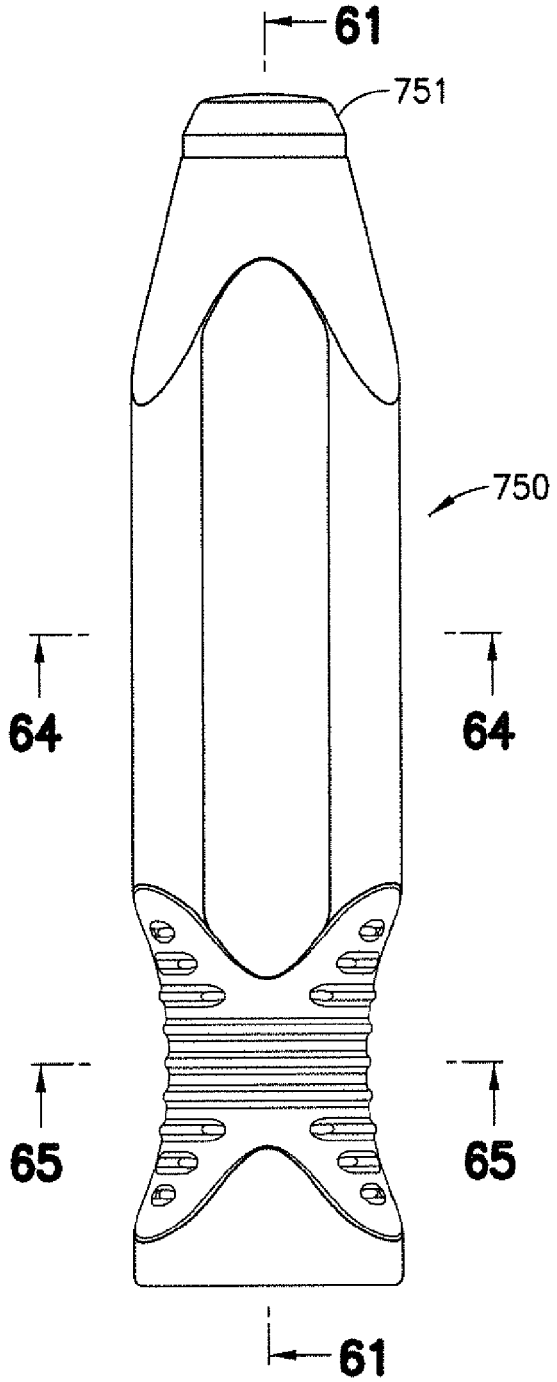
FIG. 60 is an elevational view of the tool handle of FIG. 59.
Figure 61:
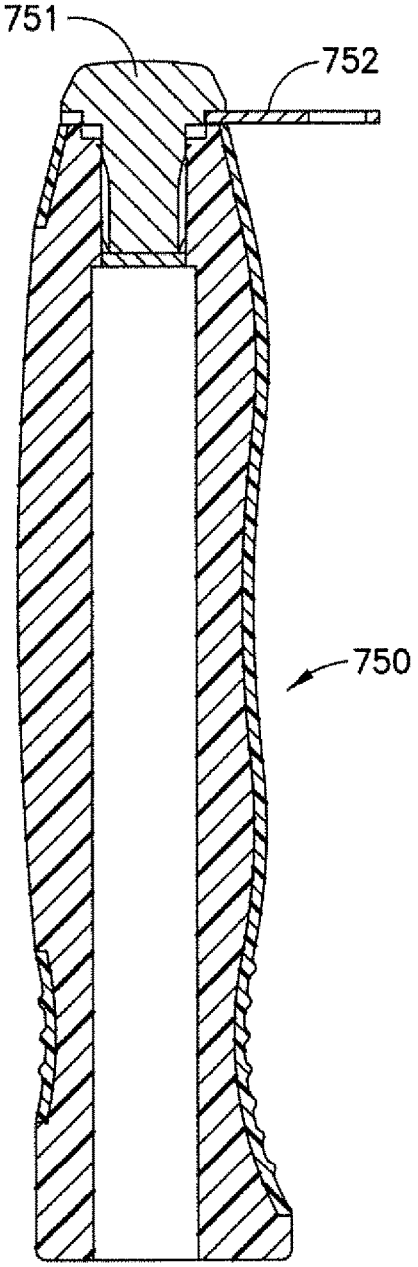
FIG. 61 is a sectional view taken along line 61-61 of FIG. 60.
Figure 62:
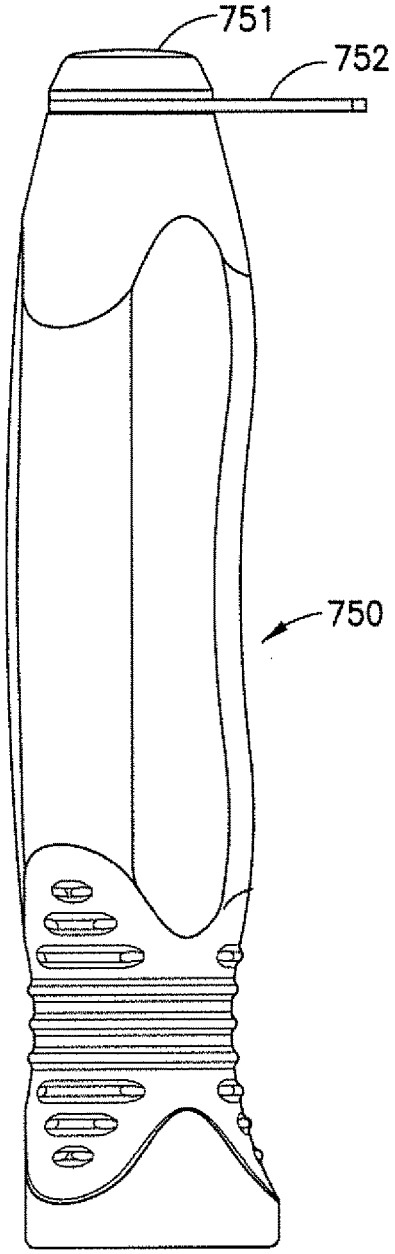
FIG. 62 is a side elevational view of the tool handle of FIG. 60.
Figure 63:
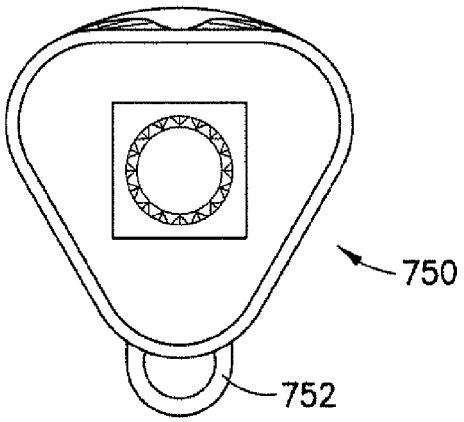
FIG. 63 is a distal end view of the tool handle of FIG. 60.

Referring to FIGS. 52-58, there is shown the heavy duty pry bar handle 700. Handle 700 has a fixedly disposed metal end cap 701. Proximate end grip portion 705 has an upper surface 706 and lower surface 707. Lower surface 707 is sinusoidal as at 707*a*, 707*b* and 707*c*. Upper surface 706 is upwardly bowed as at 706*a*. Proximate end grip portion 705 has three arcuate lobes 708*a*, 708*b* and 709. Lobes 708*a* and 708*b* are disposed at upper surface 706. Lobe 709 is disposed at lower surface 707. Lobes 708*a* and 708*b* each subtend an arc of about 45° to 90°. Lobe 709 is of lesser curvature than lobes 708*a* and 708*b*. Lobes 708*a*, 708*b* and 709 are over molded with elastomeric material. Handle 700 has two generally planar surfaces 711 between lobes 708*a* and 709 and 708*b* and 709 respectively (FIG. 57). Upper surface 706 is arcuate and is contoured with over molded lobes 707 and 708. In this manner of construction, there is an improved grip for heavy duty pry bar use. Distal grip portion 720 is disposed at neck 725 and has a plurality of tapered ridges in parallel disposition as in embodiment 600. The proximate and distal grip portions complement each other for improved leverage force transmission.

Figure 64:
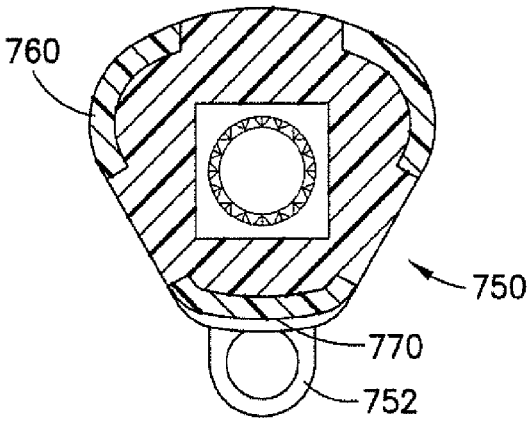
FIG. 64 is a sectional view taken along line 64-64 of FIG. 60
Figure 65:
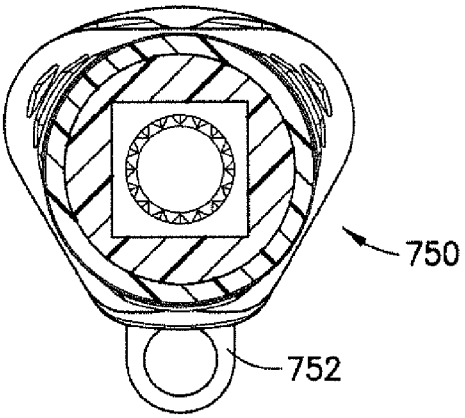
FIG. 65 is a sectional view taken along line 65-65 of FIG. 60.
Figure 66:
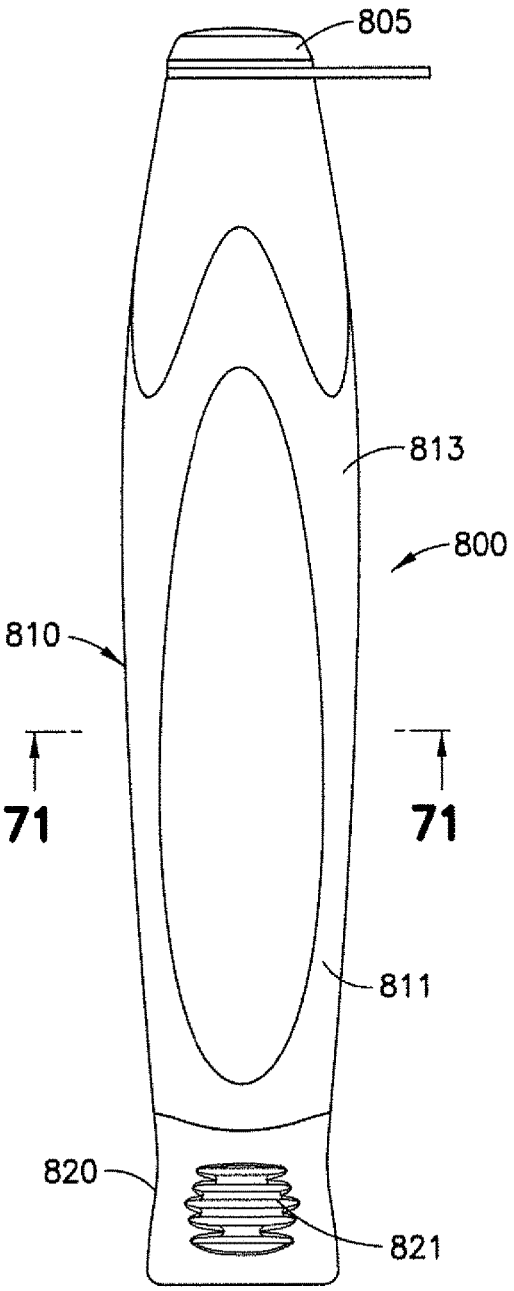
FIG. 66 is a top plan a view of a further embodiment of the tool handle.
Figure 67:
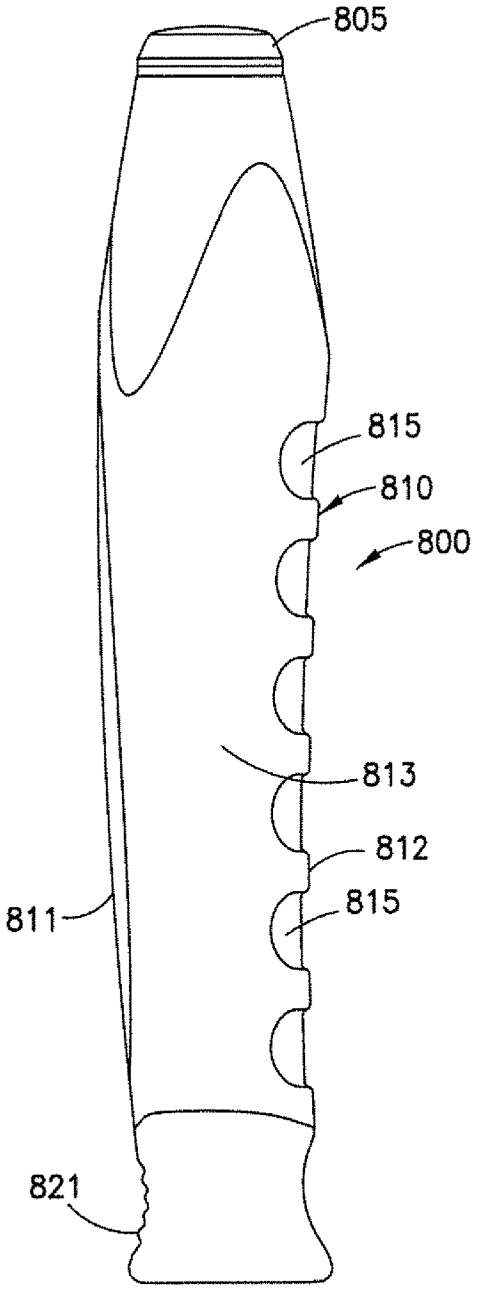
FIG. 67 is a side elevational view of the tool handle of FIG. 66.
Figure 68:
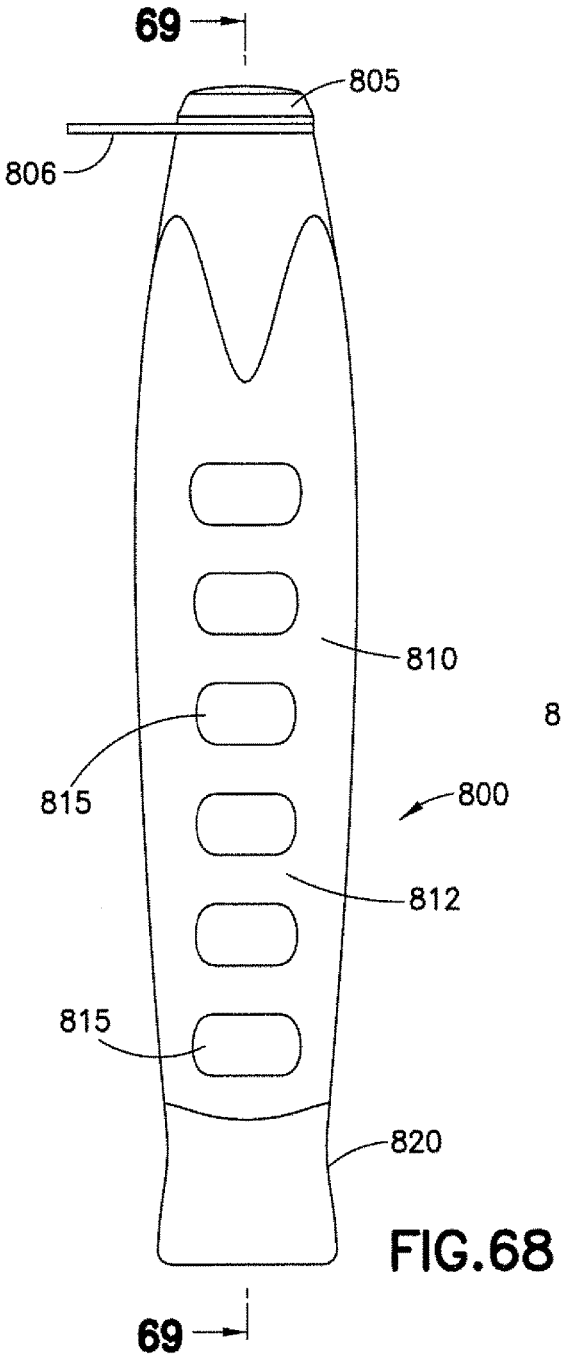
FIG. 68 is a bottom plan view of the tool handle of FIG. 66.
Figure 69:
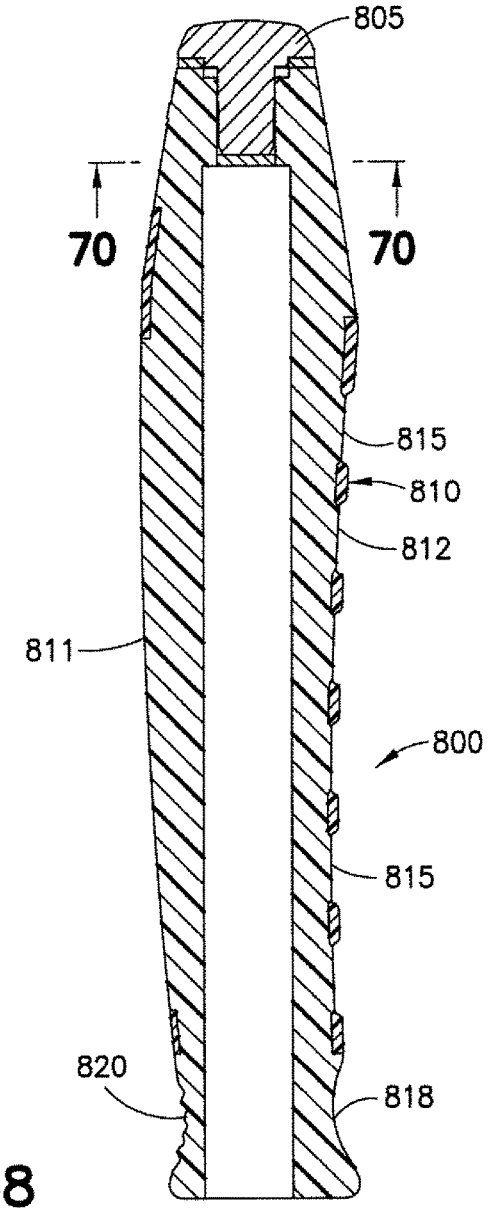
FIG. 69 is a sectional view taken along line 69-69 of FIG. 68.
Figure 70:
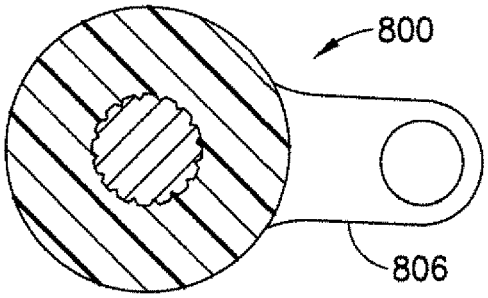
FIG. 70 is a sectional view taken along line 70-70 of FIG. 69.

Referring to FIGS. 59-65, there is shown an alternate heavy duty pry bar handle 750. Handle 750 has similar proximate end and distal end grip portions as in embodiment 700. Handle 750 has a metal end cap 751 with rotatable tang 752 of similar construction as in embodiment 600. The upper lobes 760 are of greater curvature than lower surface lobe 770 (FIG. 64).

Referring to FIGS. 66-74, there is an extreme use pry bar handle 800. Handle 800 has an elongate proximate end grip portion 810 and a proximate distal end grip portion 820. Handle 800 has a metal end cap 805 with rotatable tang 806 of similar construction to end cap 605. Proximate end grip portion 810 has an upper surface 811 and a lower surface 812. Upper surface 811 is outwardly or upwardly curved, and lower surface is inwardly curved. Grip portion 810 is over molded as at 813. A plurality of six transversely and spacedly disposed generally oval configured finger receiving recesses 815 (typical) are formed at inwardly curved lower surface 812. The over molded material 813 surrounds and defines the thermoplastic core recesses 815.

Distal end grip portion 820 is formed at neck 818. A plurality of outwardly disposed thumb engaging ridges 821 are molded or formed in the upper surface of neck 818. A rectilinear hole 825 is molded or formed along the centerline of the tool handle and extends from the distal end of the handle to the end cap for receiving a pry bar blade or like tool blade (FIGS. 3-6).

Figure 71:
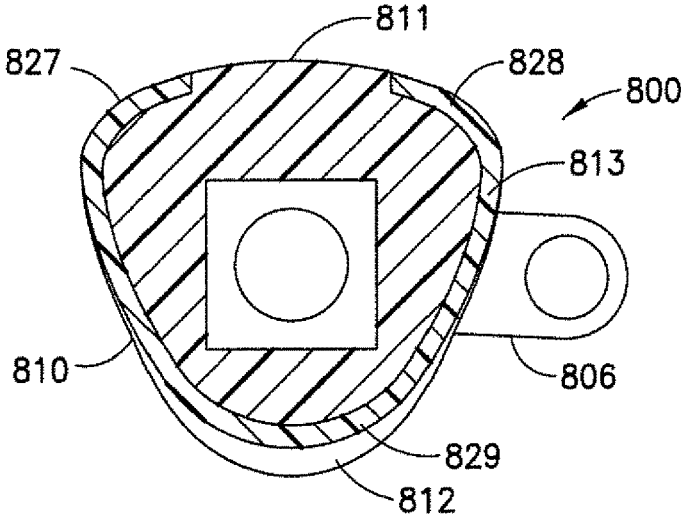
FIG. 71 is a sectional view taken along line 71-71 of FIG. 66.
Figure 72:
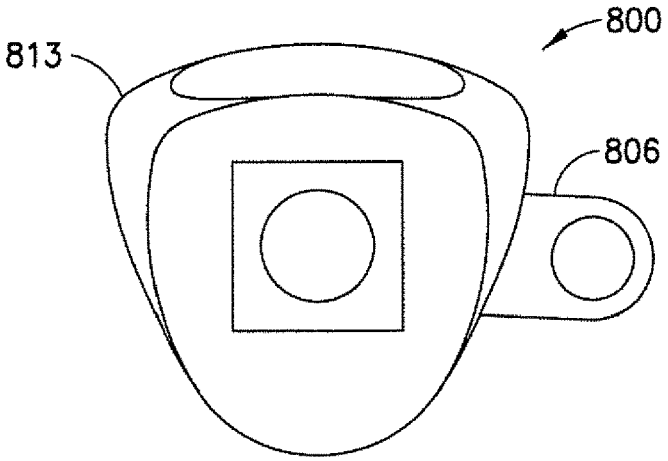
FIG. 72 is a distal end view of the tool handle of FIG. 66.
Figure 73:
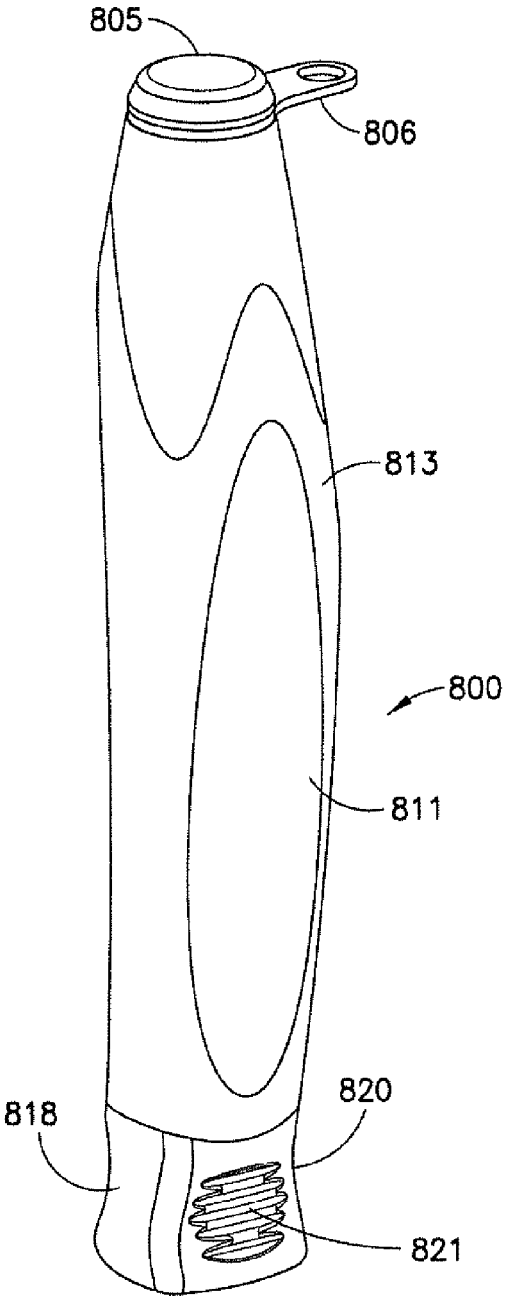
FIG. 73 is a top perspective view of an elongate extreme duty embodiment of the tool handle.
Figure 74:
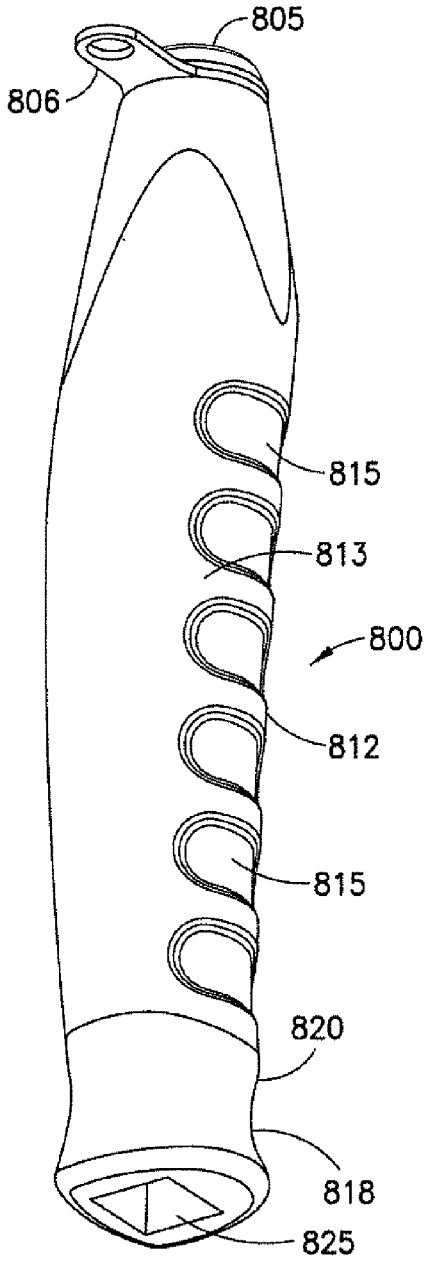
FIG. 74 is a bottom perspective view of the tool handle of FIG. 73.
Figure 75:
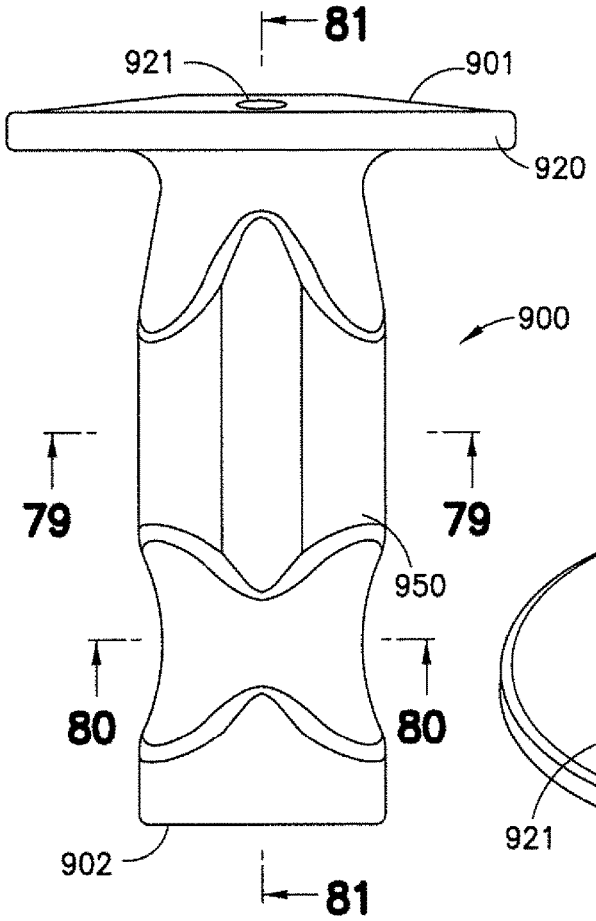
FIG. 75 is a top plan view of a striking tool sleeve handle.
Figure 76:
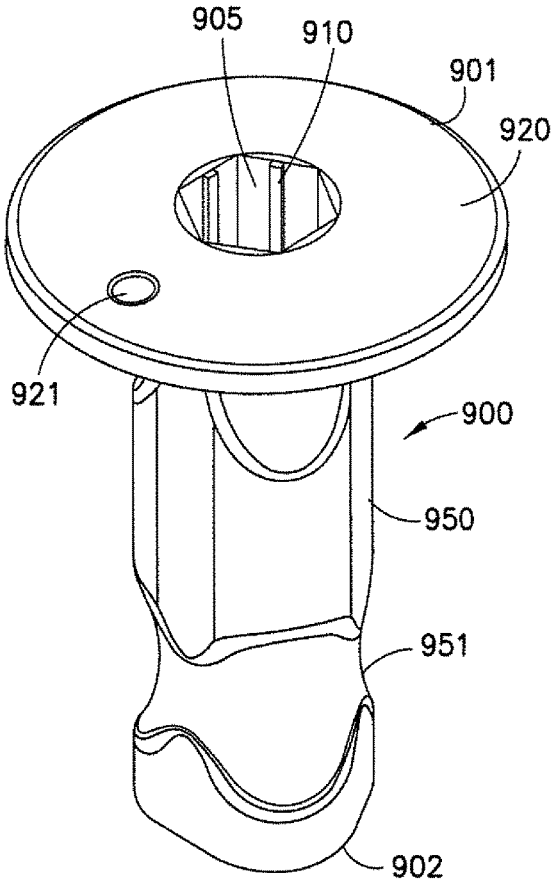
FIG. 76 is a perspective view of the sleeve handle of FIG. 75.
Figure 77:
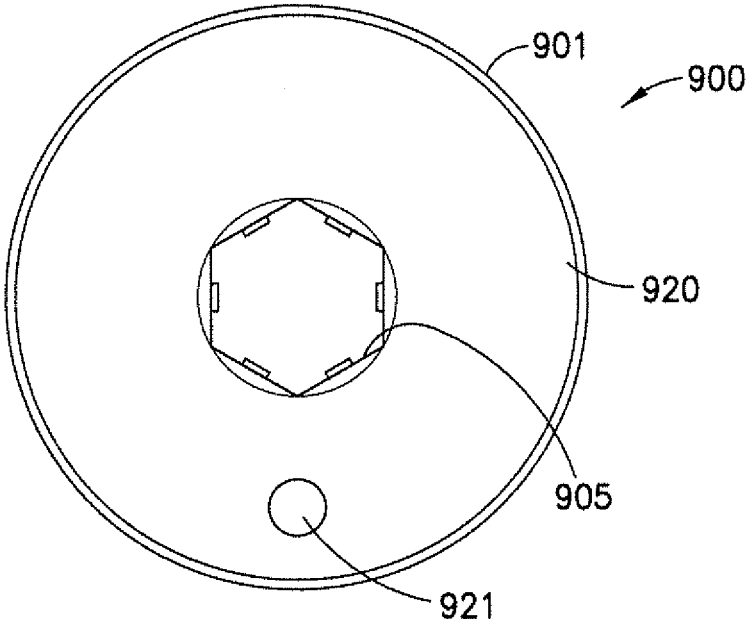
FIG. 77 is a proximate end view of the sleeve handle of FIG. 75.
Figure 78:
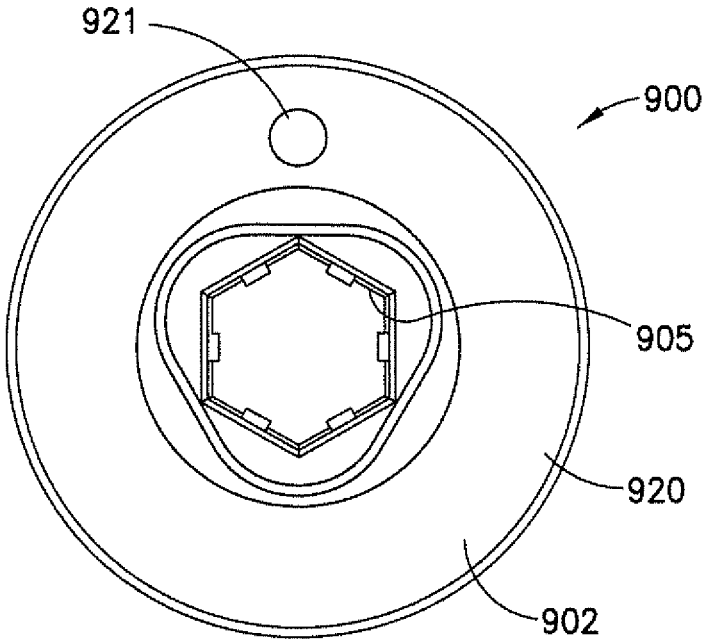
FIG. 78 is a distal end view of the sleeve handle of FIG. 75.

Referring specifically to FIG. 71, there is shown grip portion 810 having two upper surface lobes 827 and 826 and one lower surface lobe 829. Lobes 827-829 are over molded with elastomeric material 813. The over molded lobes 827 and 828 are more arcuate or of greater curvature than over molded lobe 829.

In the aforesaid manner of construction, grip portions 810 and 820, with the respective over molded arcuate portions of the lobes, and non-over molded recesses 815 and ridges 821 provide an ergonomic grip with improved leverage transmission in extreme or heavy duty pry bar use.

Referring to FIGS. 75-81, there is shown striking tool sleeve handle 900. Handle 900 has a proximate end 901 and a distal end 902. A regular hexagonal through hole 905 extends from proximate end 901 to distal end 902. A plurality of six elongate elements or splines 910 are inwardly disposed in through hole 905, and have tapered ends 905*a* (FIG. 81) for slidably receiving a hexagonal striking bar (not shown). Proximate end 901 is integrally formed with an outwardly extending cylindrical end piece or guard cap 920. Guard cap 920 is formed with through hole 921 for receiving a tether or lanyard (not shown).

Figure 79:
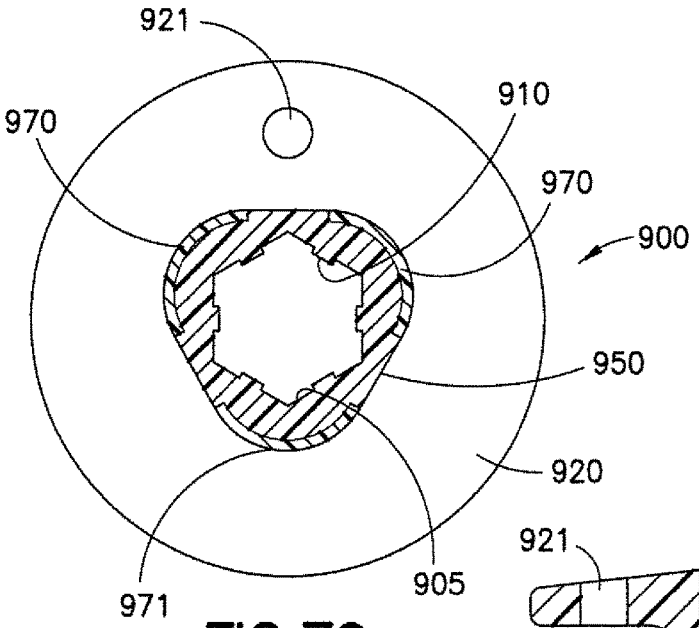
FIG. 79 is a sectional view taken along line 79-79 of FIG. 75.
Figure 80:
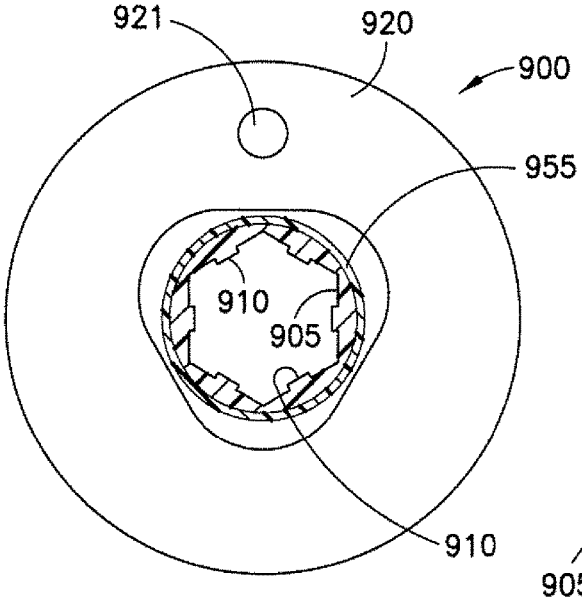
FIG. 80 is a sectional view taken along line 80-80 of FIG. 75.
Figure 81:
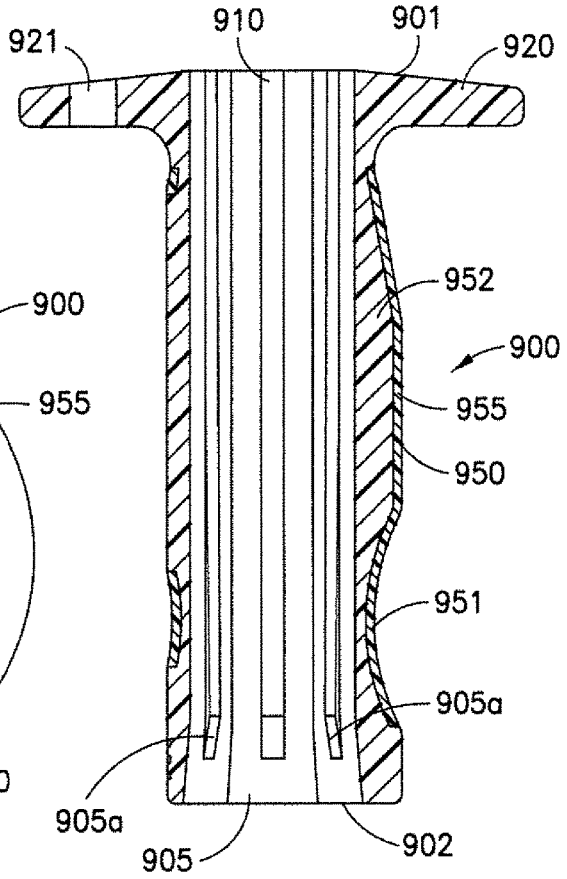
FIG. 81 is a sectional view taken along line 81-81 of FIG. 75.

Handle 900 is formed with grip portion 950 and neck 951. Grip portion 950 has outwardly extended portion 952. Over molded elastomeric material 955 extends from portion 952 through neck 951 (FIGS. 79-81). Referring specifically to FIG. 79, there is shown two upper surface lobes 970 and one lower surface lobe 971. Lobes 970 are more curved or arcuate than lobe 971, In the aforesaid manner of construction, there is provided an ergonomic grip, readily and safely usable striking tool sleeve handle.

The invention being thus described, it will be obvious that the same may be varied in many ways. Such variations are not to be regarded as a departure from the spirit and scope of the present invention, and all such modifications as would be obvious to one skilled in the art are intended to be included within the scope of the adjoined claims.

What is claimed is:

1. A tool handle comprising a proximate end and a distal end and a grip portion disposed between the proximate end and the distal end, said grip portion comprises a plurality of lobes, each said lobe comprises an outwardly disposed curved surface, said grip portion comprises three said lobes spacedly disposed about 120°;

each said lobe curved surface comprises an arcuate surface that subtends an arc of at least 45° to about 90°;

said tool comprises a centerline, said grip portion comprises an upper surface and a lower surface, and said grip portion further comprises three said lobes spacedly angularly disposed with respect to the centerline, two said lobes are disposed adjacent the upper surface and one said lobe is disposed adjacent the lower surface;

further comprising an end cap, and means for fixedly disposing the end cap to the handle proximate end;

further comprising a tang having a through hole for securing a tether, and means for rotatably disposing the tang with respect to the fixedly disposed end cap, so that said tang is slidably disposed between the end cap and the handle proximate end, whereby a tether is secured in the through hole and rotates with the tang in using the tool; and further comprising a spacer contactingly disposed between the end cap and the handle, wherein the thickness of the spacer is greater than the thickness of the tang so that the tang and tether are slidably rotatably disposed between the handle and the end cap.

2. A striking tool sleeve handle comprising:

a proximate end and a distal end and a grip portion disposed between the proximate end and the distal end, and said grip portion comprises a plurality of lobes, each said lobe comprises an outwardly disposed curved surface, said handle having a plurality of generally planar surfaces comprising a polygonal through hole extending from the distal end to the proximate end comprising means for removably slidably receiving the striking tool, wherein the polygonal through hole comprises a regular hexagon and each angle of the regular hexagon is facingly disposed at least one of an arcuate surface or a generally planar surface.

3. The striking tool sleeve handle of claim 2, further comprising an end member disposed at the proximate end and extending downwardly from the grip portion.

4. The striking tool sleeve handle of claim 3, said end member comprises a through hole for receiving a tether.

5. The striking tool sleeve handle of claim 2, said grip portion lobes comprise three said lobes spacedly disposed about 120°.

6. The striking tool sleeve handle of claim 5, each said lobe comprises an arcuate surfaced that subtends an area of at least 45° to about 90°.

7. The striking tool sleeve handle of claim 6, wherein at least one said lobe subtends an arc of about 60°.

8. The striking tool sleeve handle of claim 2, each said arcuate surface comprises over molded elastomeric material.

9. A striking tool sleeve handle comprising:

a proximate end and a distal end and a grip portion disposed between the proximate end and the distal end, and said grip portion comprises a plurality of lobes, each said lobe comprises an outwardly disposed curved surface, said handle having a plurality of generally planar surfaces comprising a polygonal through hole extending from the distal end to the proximate end for slidably receiving the striking tool wherein the polygonal through hole comprises a regular hexagon and each angle of the regular hexagon is facingly disposed at least one of an arcuate surface or a generally planar surface further comprising a plurality of ridges disposed inwardly from the generally planar surface for receiving the striking tool.

10. The striking tool sleeve handle of claim 9, said ridges having a proximate end and a distal end being tapered at the distal ends.

11. A tool handle comprising:

a centerline;

a distal end and a proximate end, and a neck adjacent the distal end;

a grip portion adjacent the proximate end, and a grip portion adjacent the distal end; said grip portion adjacent the proximate end comprises three generally arcuate lobes spacedly disposed at about 120° to the centerline; and an end cap disposed at the proximate end of the handle, said end cap comprising a centerline, and wherein the handle centerline and the end cap centerline are spacedly disposed.

12. The tool handle of claim 11, each lobe subtends an arc of about 45° to 90°.

13. The tool handle of claim 11, wherein each lobe subtends an arc of about 60°.

14. The tool handle of claim 11, said ridges being in parallel disposition.

15. The tool handle of claim 11, said ridges being in parallel disposition to the centerline.

16. The tool handle of claim 11, said ridges being transversely disposed to the centerline.

17. The tool handle of claim 16, said ridges encompass the neck.

18. The tool handle of claim 11, said portion adjacent the proximate end comprises an upper surface and a lower surface, and wherein two lobes are disposed at the upper surface and one lobe is disposed at the lower surface, and wherein the lobes disposed at the upper surface are more arcuate than the lobes disposed at the lower surface.

19. The tool handle of claim 18, said lower surface lobe comprises a plurality of spacedly disposed finger receiving recesses.

20. The tool handle of claim 19, said finger receiving recesses having an oval configuration.

21. The tool handle of claim 18, wherein the lobes comprises elastomeric material, and the surfaces between the lobes are free of elastomeric material.

22. The tool handle of claim 11, wherein the distal end comprises a blade receiving orifice extending along the handle centerline.

23. The tool handle of claim 22, said handle comprises a pry bar handle wherein the blade receiving orifice is rectilinear.

24. The tool handle of claim 11, said end cap further comprises a plurality of radially outwardly disposed tapered elements comprising radially disposed pointed elements, said end cap radial disposition being in respect to the end cap centerline.

* * * * *